US008079163B2

(12) United States Patent
Shreider et al.

(10) Patent No.: US 8,079,163 B2
(45) Date of Patent: Dec. 20, 2011

(54) EXCAVATOR AND A METHOD FOR CONSTRUCTING AN UNDERGROUND CONTINUOUS WALL

(76) Inventors: Vladimir Anatol Shreider, Sydney (AU); Natalia Shreider, Sydney (AU)

( * ) Notice: Subject to any disclaimer, the term of this patent is extended or adjusted under 35 U.S.C. 154(b) by 0 days.

(21) Appl. No.: 12/925,001

(22) Filed: Oct. 12, 2010

(65) Prior Publication Data

US 2011/0113658 A1 May 19, 2011

Related U.S. Application Data

(63) Continuation-in-part of application No. 11/881,629, filed on Jul. 30, 2007.

(51) Int. Cl.
*E02F 3/08* (2006.01)

(52) U.S. Cl. ..... 37/462; 37/465; 37/349; 37/352; 37/403; 37/449; 37/142.5; 405/267; 405/271; 405/287; 405/233

(58) Field of Classification Search ..... 37/462, 37/465, 349, 352, 353, 355, 403, 449, 195, 37/357, 142.5; 405/267, 270, 271, 266, 286, 405/287, 287.1, 233, 236, 240–242
See application file for complete search history.

(56) References Cited

U.S. PATENT DOCUMENTS 3,645,101 A * 2/1972 Sherard ..... 405/267
3,893,302 A * 7/1975 Peterson ..... 405/267
4,681,483 A * 7/1987 Camilleri ..... 405/267
5,112,161 A * 5/1992 Trevisani ..... 405/267
5,244,315 A * 9/1993 Kitanaka et al. ..... 405/267
RE34,576 E * 4/1994 Camilleri ..... 405/267
5,349,765 A * 9/1994 Kitanaka et al. ..... 37/356
5,639,182 A * 6/1997 Paris ..... 405/128.5
5,685,668 A * 11/1997 Justice ..... 405/267
5,788,422 A * 8/1998 Gardner et al. ..... 405/267
5,791,825 A * 8/1998 Gardner et al. ..... 405/267
6,059,447 A * 5/2000 Paris ..... 366/271
6,139,225 A * 10/2000 Koike et al. ..... 405/267
6,574,893 B2 * 6/2003 Mizutani ..... 37/462
7,481,604 B2 * 1/2009 Perpezat et al. ..... 405/267
2004/0208710 A1 * 10/2004 Shreider et al. ..... 405/267

* cited by examiner

*Primary Examiner* — Thomas Beach
*Assistant Examiner* — Matthew Buck

(57) ABSTRACT

A number of front working, trench filling face-compressing, inclinedly disposed sliders are arranged alternately with cutter bits on an endless chain of a trench-forming endless chain cutter on a transporting chassis, and driven with the chain by a drive means so that backward oriented, inclined facet portions of the sliders compress a filling in the trench toward and on a front working face of the wall being formed. An elongate, filling face-compressing shield is adapted to be extended down into the trench and supported with its underground portion on the underground portion of a guide post of the cutter or on the trench bottom for forward and backward oscillation by a drive means to compress the filling face adjacent to the shield. The compacted filling is in these ways being formed by horizontal pressure.

20 Claims, 9 Drawing Sheets

3
5
2A
11
9
8
14
6
E
4
G
15c
12
15a
13
F
7b
7
7a
18
14
8
3
A
1A
H
G
I
16
17
13d
13a
15
13c
14a
10
15b
J
1A1
13b 3
5
2B
11
9
6
8
14
7
4
E
19
15a
F
B
7
15c
18
13
7a
19a
G
19d
16
7b
15a
19c
1B1
1B
H
20
I
J
C
14a
15b
10
19b

13c
L
B
G
E
H
F
1B
1
A
1A
K
A,B,C,D

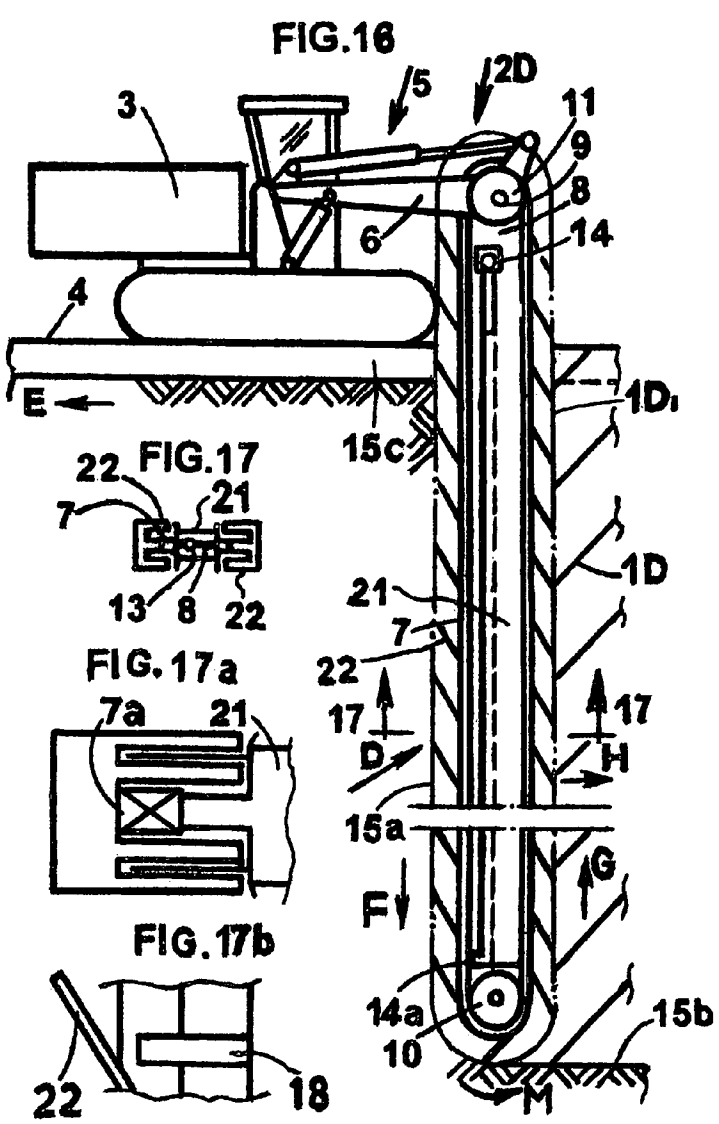
FIG.16
FIG.17
FIG.17a
FIG.17b
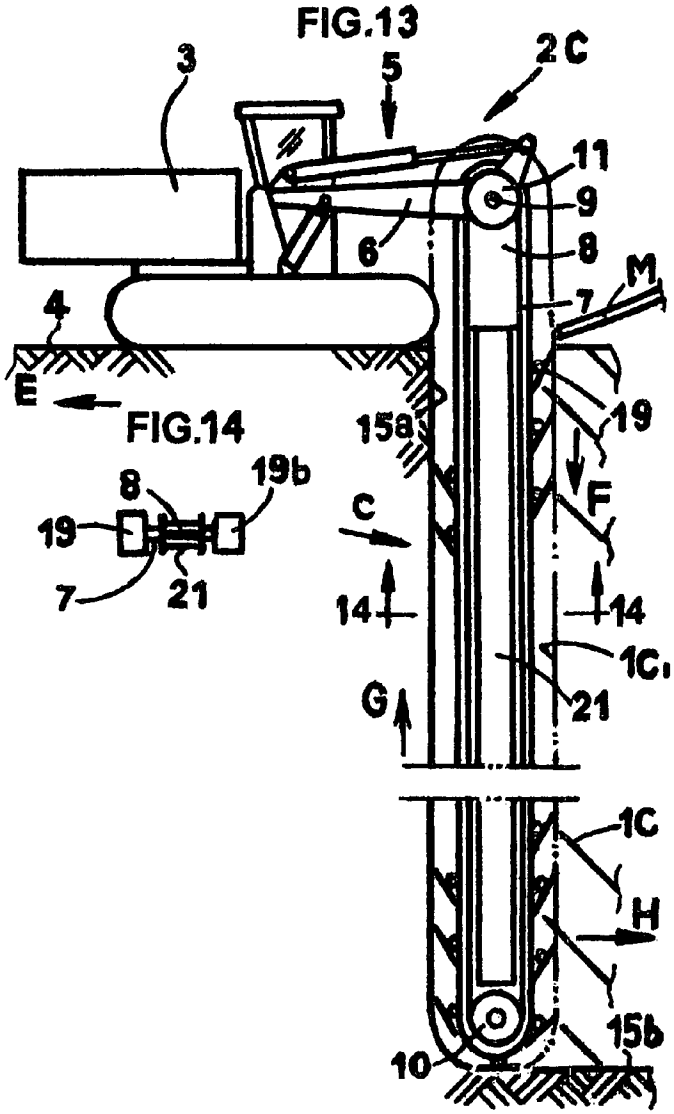
FIG.13
FIG.14

FIG. 20
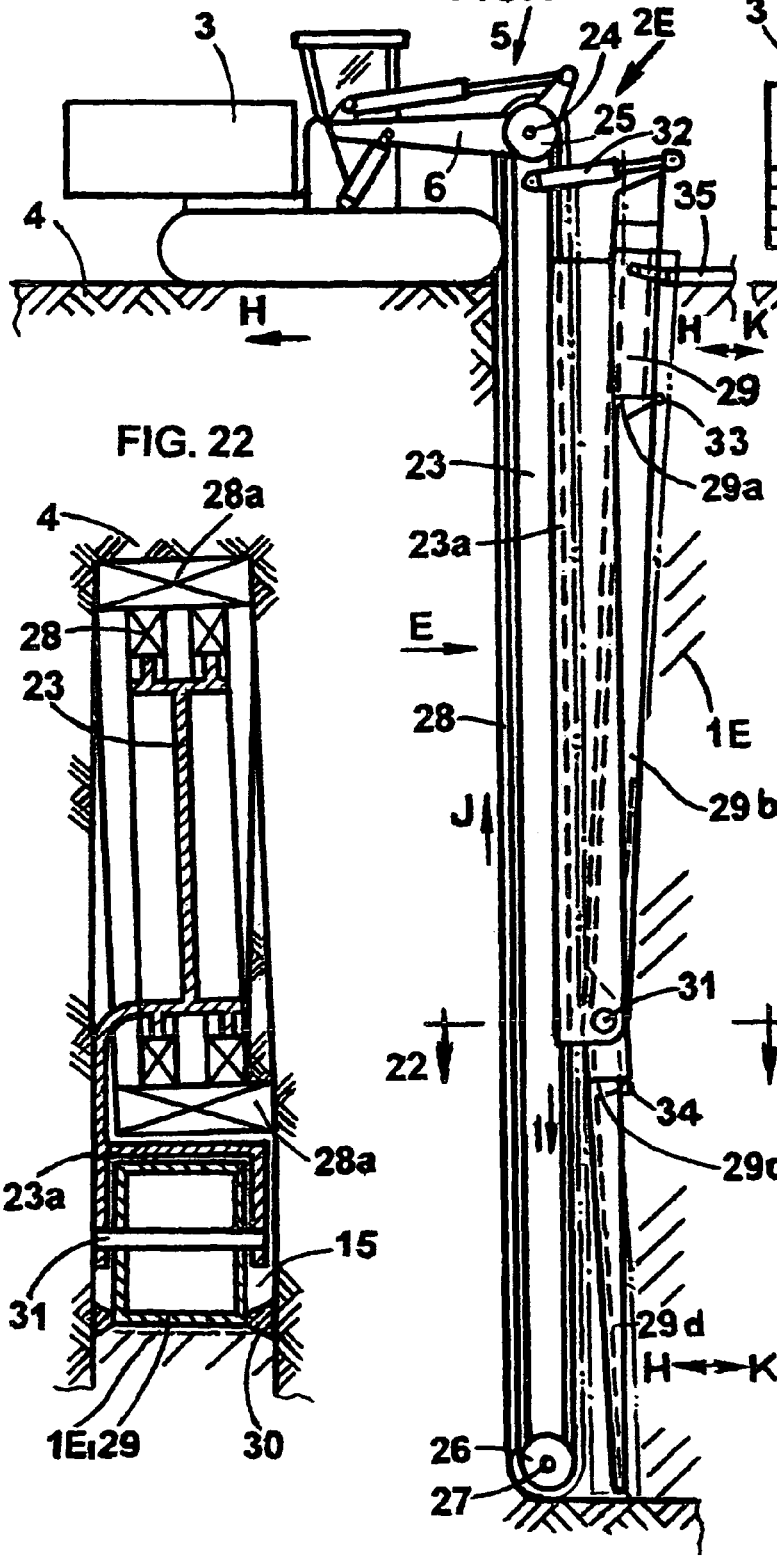
FIG. 21
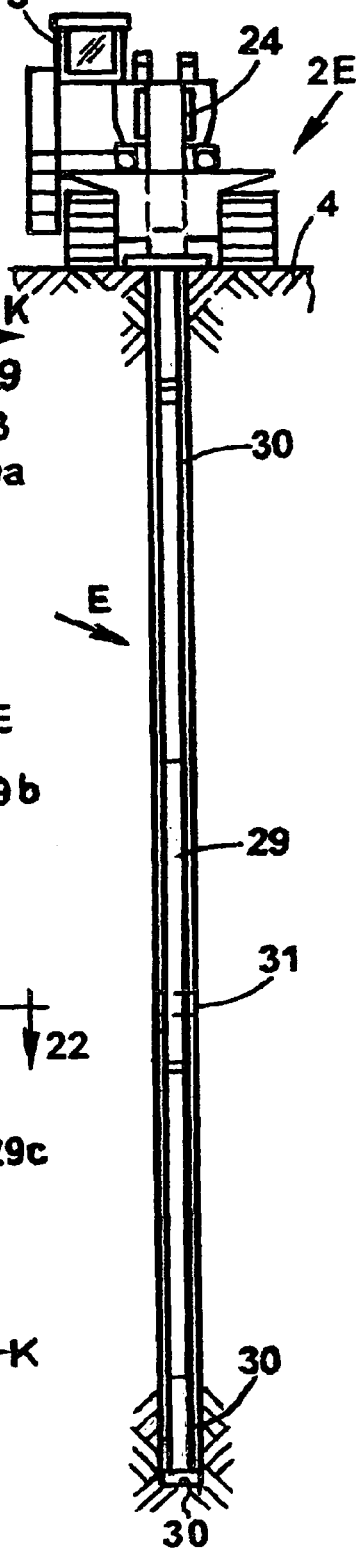
FIG. 22

3
5
37
40
2F
52
50
51a
6
4
H
F
36
41
44b
51b
42
27
K
51d
43
51c
43a
51
I
48
45
46
M
49
L
J
45a
47
1F,
1F
15b
51e
44
38
39
51f 2G
3
4
5
6
53
54
55
56
57
58
59
59a
59b
60
61
62
63
64
65
66
67
68
69
70
71
72
73
15b
G
H
J
K

EXCAVATOR AND A METHOD FOR CONSTRUCTING AN UNDERGROUND CONTINUOUS WALL

CROSS-REFERENCE TO RELATED APPLICATIONS

This application is an unelected continuation-in-part of the application Ser. No. 11/881,629, filed Jul. 30, 2007 after its restriction required with DETAILED ACTION OF May 27, 2010.

STATEMENT REGARDING FEDERALLY SPONSORED RESEARCH OR DEVELOPMENT

Not Applicable

REFERENCE TO SEQUENCE LISTING A TABLE, OR A COMPUTER PROGRAM LISTING COMPACT DISK APPENDIX

Not Applicable

BACKGROUND OF THE INVENTION

The present invention relates to an excavator for excavating ground and constructing underground continuous, draining and retaining vertical wall-shaped structures of a hardening liquid-excavated ground earth mixture or ready-mixed concrete or sand, especially to control a ground gas and water flow and to provide a drainage, isolation, containment and separation of subsurface environments, prevention of a leakage through such walls and isolation of contaminated and sensitive areas, as anchors and foundations, and to underground continuous wall-shaped structure construction methods utilizing the excavators in civil engineering and construction works.

In constructing an underground wall according to a prior art technique, first a hole of an elliptical cross-section having a 2 to 3 m major axis is dug in the ground to a predetermined depth by a powerful bucket or by two or three series of auger drills.

In constructing an underground wall according to a prior art technique, first a hole of an elliptical cross-section having a 2 to 3 m major axis is dug in the ground to a predetermined depth by a powerful bucket or by two or three series of auger drills. After the hole formed in slurry is sealed with a bentonite solution to prevent further penetration of slurry, a reinforcing bar cage is placed in the groove and a ready mixed concrete is then poured into the groove to form a foundation column. Such method is repeated to form an underground continuous wall. Slurry or bentonite solution layers interrupt the formation of the continuous wall so that after completion of the wall, ground water tends to leak into the inside of the continuous walls through the joints. It is therefore very difficult to provide the underground continuous wall simultaneously having two functions as foundation wall and a diaphragm wall.

U.S. Pat. No. 5,244,315 discloses an excavator for constructing an underground continuous wall that includes a travelling trolley, supporting frames, an endless chain cutter and agitator. The cutter excavates a trench, jets a hardening liquid in an excavated groove and mixes the liquid with the earth and sand in the groove to form a soil cement wall. Significant defects of the excavator and method of its advancement are: it is very difficult to form a deep wall in the stony ground and a horizontal stratum; the cantilever endless chain cutter being advanced that requires a huge traction force and stabilizing moment applied to the trolley; the cutter is not capable to compact the filling wall being formed and for forming a compacted running filling there is needed much more hardening liquid.

U.S. Pat. No. 5,685,668 for Barrier Wall Installation System discloses an excavator for delivering an unrolling liner material into and along a trench being formed of a depth up to sixty feet that prevents side wall collapse in a surface water saturated zone and forms a barrier wall. Significant defects of that barrier wall installation system are the similar as shown above and following: the wall may be shaped into system are the similar as shown above and following: the wall may be shaped into plane and vertical cylindrical surfaces only because of the cylindrical shape of a roll of the liner material; it is difficult to use a wide liner material of a width that is sufficient to reach a first confining bed.

BRIEF SUMMARY OF THE INVENTION

It is, therefore, an object of the invention to provide a more efficient excavator for constructing an underground, substantially smoothly continuous, multifunction compacted filling wall such as a vertical preferably drain, diaphragm, anchor and foundation wall and the like that being formed in the ground in a broadened field of use and in simple processes in a shorter construction period.

It is another object of the invention to provide construction methods for constructing the underground filling walls, which methods are able easily and rapidly construct the underground continuous wall without joints and without any risk of leakage of ground water with the use of the excavator.

In order to accomplish the first object, there is a number of preferable embodiments of the excavator according to the invention, each of the embodiments comprises a transporting chassis movable along the length of a line of the wall in an intended direction of advancement of the wall over the ground to produce the wall which extends in that direction in a section of a slot trench; a supporting framework mounted on the chassis and adapted to be transported in the direction over the ground to produce the wall, an inclinedly disposed, elongate, filling-compressing device adapted to extend down into the section from the framework; a means supporting the compressing device on the framework for movement in intended compressing directions; a drive means for producing the movement of the device in the compressing directions, so that the device compresses a front working face of the wall being formed as the framework is transported in the advancing direction.

In the general preferred feature of the invention, the device comprises an oriented in the intended compressing direction, the compressing direction being along the face, longitudinally displaceable, elongate motive member and a number of compressor slider members arranged on the motive member to form a linear compressor; the supporting means supports the motive member for the longitudinal movement in the compressing direction; each of the slider members is being capable of engaging movingly on side walls of the section and has a filling-compressing slide able facet portion capable to be positioned at a back angle, the back angle being equal to about 20-30° in relation to the compressing direction, the angle is depended on the cohesion and lesser than the angle of sliding friction of the portion on the filling, and operable by the drive means capable of producing the longitudinal movement so that the facet portion of each of the slider members alternately compresses the friable filling toward and on the face and retreats from the filling.

Especially, a number of cutter bits and a number of the shortened compressor slider members are alternately arranged on an endless chain to form an endless chain cutter adapted to extend into the ground from the framework and comprising a chain driving wheel on the framework, a tiltable guide post supported by the framework and positioned below the chain driving wheel, the endless chain extending around the chain driving wheel and the guide post, and where the drive means is capable of effecting relative movement between the framework and the chain driving wheel.

Moreover, each of the slider members has a forward oriented, in relation to the compressing direction, cutter edge portion and opposite inner and outer, in relation to the endless chain, facet portions and being supported on the endless chain for pivoting about a generally horizontal pivot axis, the axis being within the pivotable slider member and the chain and perpendicular to a central surface of the chain, between a front filling-compressing position ahead of, in relation to the advancing direction, the guide post having a friable earth filling-streamlined cross-section, where the front position being secured by a traction force of the driving wheel and resistance of a guide member supported motionless on the upper portion, located closely above the ground surface of the guide post and below the chain driving wheel, and the ground being excavated from a front working wall of the excavated section being formed, and the earth filling being compressed, an a limit stop of the chain and and a rear, filling face-compressing position at behind the guide post, where the rear position being secured by an opposite edge portion of the pivotable slider member and a limit stop of the chain, and where the opposite facet portions are operable by a return spring disposed between the and the pivotable slider member and capable of forcing the slider member to pivot about the pivot axis from the front position into the rear position and against resistance of the face being compressed; where the drive means with the chain driving wheel is capable of effecting the relative movement between the chain and the slider members against the resistance of the springs being deformed.

Furthermore, the guide post is provided with elongate, front and rear, in relation to the advancing direction, partitions extending from the framework along the length and oppositely aside of the guide post and across the excavated section with a sealing means located at side edges of the partitions for engaging on side walls of the section and adapted to engage movingly with the slider members, and to close off the interior of the section ahead of the front partition in relation to the interior of the section at the filling face being formed behind the rear partition to secure removing of the earth and forming the friable filling of the ready filler material and compressing the friable filling on the lower portion of the face. The slider members are being fixed on the chain and adapted to engage movingly with the partitions.

A next object of the invention is the device comprising a shield adapted to extend across the excavated section and provided with a sealing means on its side edges for engaging on side walls of the section to close off front and rear interiors of the section ahead and behind of the shield, in relation to the advancing direction, and prevent the ingress of the runnable filling into the front interior; and where the supporting means is capable of supporting the underground portion of the shield in the section for alternating oscillation in the compressing directions.

In variants of the supporting means according to the invention, the portion is being supported on an underground portion of a vertically disposed, elongate guide post of a trench-forming endless chain cutter supported on the framework and adapted to extend into the ground as the framework is transported in the advancing direction. The framework comprises a tiltable upper frame arranged on the chassis and the endless chain cutter has a tiltable guide frame pivoted at its portion to the upper frame, a driving wheel and a number of guiding and supporting sprockets rotatably connected to the guide frame, an endless chain extending around the sprockets and the driving wheel, and a number of cutter members arranged on the endless chain.

In the first variant of the supporting means, a central longitudinal plane of the shield being crossing a central longitudinal plane of the endless cutter at an acute angle, the angle being equal to about 88-89°; the underground portion of the guide post is extending backward, in relation to the advancing direction, closely aside of the cutter bits within the angle and up to behind the cutter and being capable of supporting the underground portion of the shield; and where each of the cutter bits is capable of being forced into interaction with a facial wall of the excavated section being formed to urge the endless cutter in a direction crossing the planes toward the intended advancing direction.

In the second variant of the supporting means, the endless chain cutter comprises a shield-supporting cam wheel that being supported on the underground portion of the guide post for rotation about a generally horizontal rotation cam axis, the rotation cam axis being perpendicular to the central longitudinal plane of the cutter, connected cinematically to the endless chain and capable of supporting mutually the underground portions of the guide post and the shield and comprising a plurality of shield-supporting and agitating radial cam portions having predetermined radial lengths and the ability of extending aside and past the chain and between the cutter bits toward the underground portion of the shield; where the underground portion of the shield is provided with a number of forward oriented, in relation to the advancing direction, cam portions and shield-supporting wheels located oppositely to the cam wheel and supported on the underground portion of the shield for rotation about generally horizontal wheel rotation axes which being perpendicular to the central longitudinal surface of the cutter and shield and capable of interacting with the cam portions; where the cam portions are operable to support mutually and continuously the lower ends of the guide post and the shield and oscillate vibratory the shield backward and forward relatively to the guide post and the advancing direction about the shield upper end by the drive means capable of moving the chain with the chain driving wheel relatively to the framework and the guide post and rotating the cam wheels about the cam rotation axis and the shield wheels about the shield wheel rotation axes to effect continuous supporting the face on the underground portion of the cutter and on the facial wall of the section and alternating backward and forward oscillation of the shield about the shield upper end to effect continuous compacting the face.

Each of such shields is capable of supporting variants of filling-forming and compressing spiral slider devices.

The first variant of the spiral slider devices is a spiral screw device comprises the number of the compressor members shaped into elongate, disposed co-axially, in relation to a central axis, similar in construction, screw spiral blades capable to be provided on their outer screw edges with a plurality of cutter bits to form the screw cutter, supported for rotation about the central axis in a direction opposite to the screw spiral and have inner screw edges and the screw spiral slider facet portions disposed at an angle of helix, the angle of helix is equal to about 10-15°, oriented downward and outward and having an axial cross-section inclined at the back angle in relation to the central axis and operable to displace the filling in the downward and outward directions, and the drive means capable of rotating the screw blades which generate an injection channel extending down from the ground surface and opening radially between adjacent coils and at the lower ends of the blades, thereby compressing the filling toward a bottom of the section and the face.

The second variant of the spiral slider devices is a spiral wing device having a cutter and compressor member shaped into a vertically disposed, elongate wing blade supported for rotation about its generally vertical central axis and having outer edges, diagonally opposite portions between the edges have a mirror symmetrical, in relation to the central axis, equiangular for the back angle, spiral cross-section and operable to displace the filling in outward radial directions, the drive means is capable of rotating the wing blade in a direction opposite the spiral, whereby the wing blade generates an injection channel extending from the surface of the ground toward the lower end of the blade and opening oppositely and radially within the length of the blade.

Moreover, accordingly to the invention, a feed pipe is extending from the framework into the compressing shield and having branched lower ends opening at intended locations along the length of the shield. The feed and compressor pipe shield has: a <-shaped central longitudinal axis with a forward, in relation to the advancing direction, oriented ridge; an upper portion located above the ridge and comprising an upper compressing facet portion and an upper portion of the pipe with an entrance opening and an upper check valve capable of opening downward; a middle chute-shaped portion with a side opening oriented backward; and a lower portion located below the ridge and comprising a lower end of the pipe at the ridge with an exit opening and a lower check valve capable of opening downward to form a displacement pump, and a lower compressing facet portion and a ski means for supporting an upward oriented face of the filling being compressed, the ski means is adapted to be transported in the advancing direction above the excavated section and being connected to the framework; and a means supporting the shield pipe on the underground portion of the tiltable guide post for alternating forward and backward, in relation to the advancing direction, oscillation about a generally horizontal pivot axis, the pivot axis being at the ridge and perpendicular to the advancing direction; and a drive means for producing the alternating forward and backward oscillation of the shield pipe about the generally horizontal pivot axis, so that the opposite facet portions of the shield pipe disposed above and below the generally horizontal pivot axis alternately compress and retreat from upper and lower portions of the compressed filling face of the filling being formed, generate and fill with the running ready filler material upper and lower gaps between the facet portions and the face and compress the filling on the face as the framework is transported in the advancing direction.

In further modification of the excavator according to the invention, the compressor shield is being disposed at an acute front angle in relation to the horizontal plane and a bottom of the excavated section, the angle being equal to no more than about 55-65°, and the supporting means comprises a face- and bottom-compressing tail means having a ski member movable along the bottom in the advancing direction and a carriage member connected to the ski member and to a lower end of the shield for relative reciprocation of the shield in the transversal compressing direction and the ski member in vertical direction, and the drive means is capable of producing relative reciprocation between the shield and the ski member to effect compaction of the face and the bottom.

In order to accomplish the second object, in the underground continuous wall construction method using the excavator described above, the method according to the invention comprises steps of:

digging a section of the excavation along a line of the excavation in the ground to a predetermined depth and in an intended advancing direction by means of an excavating device;

feeding an intended filler material into the excavated section to form a filling within the section; inserting a device for compressing the filling, the compressing device being part of the excavator, into the filling, thereby compressing the filling toward and on a front working face of the compacted filling wall to form the wall.

Moreover, the method further comprising the steps of: excavating the ground in the direction by means of an endless chain cutter, the endless chain cutter being part of the excavator, while inserting a compressor substantially similar in construction to the endless chain cutter and having an improving filler liquid injection pipe to jet an improving filler liquid in the excavated section, thereby compressing pair of the earth filling and the improving liquid filling being mixed in the excavated section toward and on the face to form the compacted and improved earth wall.

Furthermore, the method comprises the steps of: inserting front and rear partitions, the partitions being part of the endless chain cutter, into the earth filling being formed in the excavated section; feeding an improving filler material into the excavated section ahead of the front partition; compressing pair of the improving filling and the earth filling being mixed in the section ahead of the front partition toward and under lower ends of the partitions and on a lower portion of the face to form the compacted and improved-earth wall from its lower portion.

The method further comprising the steps of: removing the earth, inserting a shield-shaped feed pipe, the injection pipe being part of the forming means, between the endless chain cutter and the face to feed a running ready filler material into the excavated section, thereby filling the section between the compressing pipe shield and the face with the ready filler material and compressing the ready filling toward and on the face to form a compacted ready filling wall.

BRIEF DESCRIPTION OF THE SEVERAL VIEWS OF THE DRAWINGS

FIG. 13 is a side view of a third preferred embodiment of the excavator according to the invention;

FIG. 14 is a cross-sectional view taken on line 14-14 of FIG. 13 of the endless chain cutter of the excavator shown in FIG. 13;

FIG. 16 is a side view of a fourth preferred embodiment of the excavator according to the invention;

FIGS. 17, 17*a* and 17*b* are a cross-sectional taken on line 17-17, from below and side views partly on a slightly enlarged scale of one example of a compressor slider used in the endless chain cutter of the excavator shown in FIG. 16 according to the invention, respectively;

FIG. 20 is a side view of a fifth preferred embodiment of the excavator according to the invention;

FIG. 21 is a view from the rear of the excavator shown in FIG. 20;

FIG. 22 is a cross-sectional view taken on line 22-22 on a slightly enlarged scale relative to the FIGS. 21 and 22 of a compressor pipe shield used in the endless chain cutter of the excavator shown in FIG. 20 according to the invention;

DETAILED DESCRIPTION OF THE PREFERRED EMBODIMENTS

Figures 1, 2, 3, 4A, 4B, 4C, 4D:
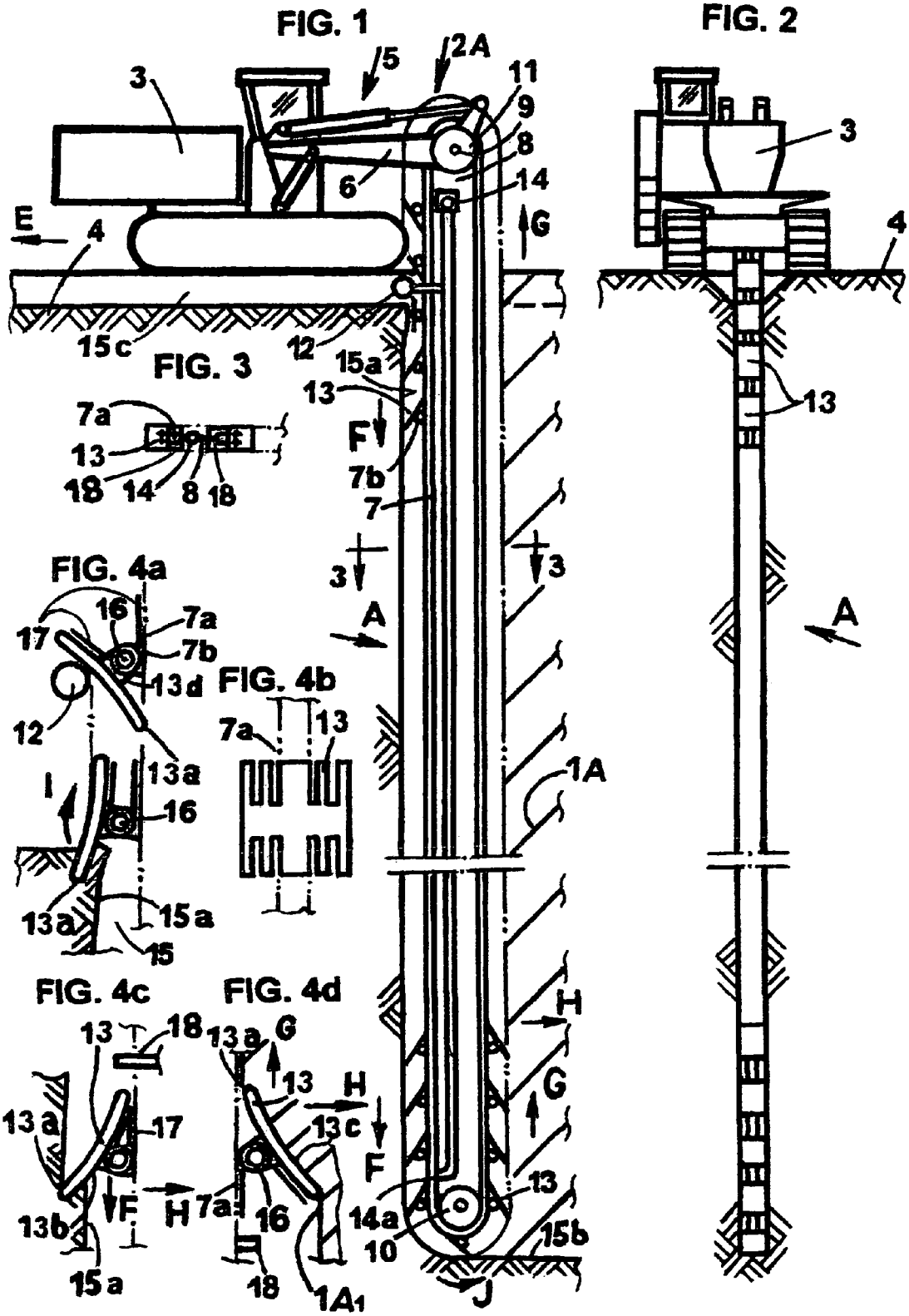
FIG. 1 is a side view of a first preferred embodiment of the excavator according to the invention.
FIG. 2 is a view from the rear of the excavator shown in FIG. 1.
FIG. 3 is a cross-sectional view taken on line 3-3 of FIG. 1 of the endless chain cutter of the excavator shown in FIGS. 1 and 2.
FIGS. 4*a*, 4*b*, 4*c* and 4*d* are side view at turning from a rear compressing position into a front compressing position, from the rear, side in the front position and in the rear position views on a slightly enlarged scale relative to the FIGS. 1 to 3 of one example of compressor sliders used in the endless chain cutter of the excavator shown in FIGS. 1 to 3, respectively.

In the describing of the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

An underground continuous compacted filling wall such as a horizontally extending vertical preferably wall that is constructed with the aid of the excavator depicted in the drawings embodying the teachings of the subject invention. Each of later described and illustrated embodiments of the constructing excavator has a device for compressing a front working face of the filling wall to form the compacted filling wall. Each of later described and illustrated modifications of the compressing device is able to force a filling from its position in an excavated section to and on the face of the wall being formed at behind the excavator to form the face and force the face in a crossing direction opposite an intended advancing direction to compact the face being formed to form a compacted filling wall according to the invention.

FIGS. 1 throughout 35 depict embodiments 2A throughout 2G of an excavator 2 using modifications A throughout G according to the invention of a generally endless chain cutter for constructing varieties 1A throughout 1G of an underground continuous, compacted filling wall 1 and methods of construction of the wall 1 that according to the invention and using the embodiments 2A-2G.

The embodiment 2A as shown in FIGS. 1 and 2 comprises a traveling chassis 3 for transporting an endless chain cutter A for forming the wall 1A and supplying power and a filler material to the cutter A, the chassis 3 being movable on the ground 4 in an intended advancing direction shown by an arrow H in FIG. 1 along the length of a structure line, a supporting framework 5 mounted on the chassis 3 and adapted to be transported in the direction H over the ground 4 to connect the chassis 3 to the endless chain cutter A and to dispose and advance the cutter A in the direction H and comprising an upper tiltable frame 6 connected at its front portion to the chassis 3 with a known lifting, supporting and guiding means (not shown) and a lower tiltable frame (later described) pivoted at its portion to the frame 6 and adapted for supporting and guiding components of an endless cutter such as the cutter A, an endless member such as chain 7 displaceable longitudinally in directions shown by an arrow I in FIGS. 1, 4*a* and 4*c* and by an arrow J shown in FIGS. 1 and 4*d,* a lower tiltable, elongate, disposed vertically preferably, endless chain-guiding and supporting frame or post 8 as shown in FIGS. 1 and 2 and having a central longitudinal surface, substantially similar in shape to a cross-section of a central longitudinal surface of the wall 1A which is to be formed; a known saddle (not shown) slidably arranged on rails (not shown) disposed longitudinally on the guide post 8 and adapted to be driven relative to the guide post 8 by a drive means (not shown); a hydraulic preferably drive means such as power hydraulic motor 9 provided preferably on the guide post 8 and having an output shaft (not shown); a chain sprocket 10 supported rotatably on a lower end of the guide post 8; a chain driving wheel 11 supported rotationally to the saddle and connected to the shaft for driving the chain 7 extending around the chain sprocket 10 and the chain wheel 11; a baffle member 12 which is supported by and at ahead of the guide post 8 for guiding a number of cutter and compressor sliders 13 arranged on the chain 7 to form an endless chain cutter A; an injection pipe 14 for jetting a running, earth-improving material such as lubricating water or sealing clay fluid or hardening cement milk into the sections that extending, from the frame 6 into the guide post 8 and having orifices 14*a* opening at intended locations along the length of an underground portion, preferably at a lower end of the guide post 8.

One example of arrangement of the cutter and compressor sliders 13 is shown in FIGS. 1, 2, 3, 4*a*, 4*b*, 4*c* and 4*d*. Each of the sliders 13 has a cutting edge 13*a* oriented alternately downward in the direction I for excavating the ground 4 from a working facial wall 15*a* of the excavated section 15 to advance the section 15 and form a filling of the earth in the section 15 and in the direction J for further scraping the filling of the earth at behind the guide post 8; a backward oriented, in relation to the advancing direction H and in a direction shown by an arrow K in FIGS. 1, 4*c* and 4*d* compressing slider facet portion 13*b* as shown in FIG. 4*c* that is oriented at a back angle relative to the direction I when being ahead of the guide post 8, where the back angle is equal to about 25-30°, preferably 30° depending on the cohesion and the friction angle of the compressed filling on the portion 13*b* and capable of forcing the filling of the earth from its position ahead of the guide post 8 in a direction shown by an arrow K in FIGS. 1, 4*c* and 4*d* past and to behind the guide post 8 to form the face $1A_1$; and a facial slider facet portion 13*c* as shown in FIG. 4*d* oriented at the back angle in relation to the direction J when being at behind the guide post 8 and capable of further forcing the earth in the direction K and compressing on the face $A_1$ thereof; a number of bearing lug portions 13*d* distributed transversally within the portion 13*c*, preferably in its middle, and extended toward a support chain link 7*a* of the chain 7 as shown in FIGS. 4*a* to 4*d* and connected to a number of co-axial bearing lug portions 7*b* of the link 7*a* extended transversally and toward the slider 13 by means of an elongated bearing part such as a slider pivotal pin 16 permitting oscillation of the slider 13 about a generally horizontal pivotal axis of the pin 16 relative to the chain 7, where the slider pivotal axis being perpendicular to the central longitudinal surface of the cutter A, between limit stops (not shown) such as edge portions of the chain links 7*a* and between a ground-cutting and filling of the earth-compressing operative position ahead of the guide post 8 as shown in FIG. 4*c*, where the slider 13 being displaced in the direction I, and a filling of the earth-compressing and face $1A_1$-forming and compressing operative position at behind the guide post 8 as shown in FIG. 4*d*, where the slider 13 being displaced in the direction J; a spiral screw return spring 17 placed co-axially on the pin 16 and fixed with its distant ends to the chain link 7*a* and to the slider 13. The slider pivotal connection and the spring 17 permit the slider 13 when it being forced into interaction with the baffle rod 12 as shown in FIG. 4*a* to be turned about the axis of the pin 16 from a first limit stop and the compressing operative position remaining over the ground 4 and represented in FIGS. 4*d* and 4*a* in a direction shown by an arrow L in FIG. 4*a* into an inoperative longitudinal position and then by aid of the resistance of the wall 15*a* to cutting which impeding the edge 13*a* located remotely from the axis of the pin 16 from the inoperative longitudinal position into the cutting and compressing operative position at a second limit stop shown in FIG. 4*c*.

Each of the sliders 13 can be shaped into an agitator comb as shown in FIG. 4*b*. A number of agitator bars 18 can be fixed on and perpendicularly to faces of the guide post 8 with the ability to pass through comb hollows of the sliders 13. The sliders 13 and the bars 18 being capable of agitating the filling of the earth and the improving material being injected through the injection pipe 14 to mix them together.

As seen in FIG. 4*a*, each of the sliders 13 is caused to move with the endless chain 7 from the driving wheel 11 above the ground 4 in the direction I and forced into interaction with the baffle rod 12 remotely from the pivotal axis of the pin 16 so that the rod 16 and the chain 7 with the driving wheel 11 are capable to turn the moving slider 13 about the axis of the pin 16 from the compressing operative position so as shown in FIGS. 4*d* and 4*a* against the resistance of the return spring 17 in the direction L into the cutting and compressing operative position so as shown in FIGS. 4*a*, 4*b* and 4*c*. When the sharpened edge 13*a* of the slider 13 moves in the direction I, a trench section 15 will form as the ground 4 is excavated from the wall 15*a* and a trench filling of the earth will form as the earth is loosened and agitated to be mixed with the improving material which being injected through the injection pipe 14.

As the portion 13*b* of the slider 13 which being in the cutting and compressing position at the back angle that moves in the direction I, the structure face $1A_1$ will be formed at behind closely the guide post 8 as the earth and the improving material are forced from their position at the wall 15*a* in the direction K past and to behind closely the guide post 8 and agitated by means of the sliders 13 and the bars 18 to be mixed and compressed toward the face $1A_1$. After the slider 13 is caused by the wall 15*a* to turn with the sprocket 10 and form a bottom 15*b* of the section 15, the spring 17 turns the unloaded slider 13 from the cutting position as shown in FIG. 4*c* in a direction shown by an arrow M in FIG. 1 relative to the chain 7 against the lesser resistance of a soft mixture of the earth and the improving material into the compressing position shown in FIG. 4*d* and keeps the slider 13 in the latter. As the portion 13*c* of the slider 13 in the compressing position at the back angle in relation to and in the direction J as shown in FIG. 4*d* that moves closely at behind the guide post 8, the compacted filling wall 1A will form as the mixture of the earth and the improving material on the portion 13*c* is agitated, forced in the direction K and compressed on the face $1A_1$.

The drive motor 9 with the sliders 13 can be used to assist the chassis 3 in moving up the guide post 8. The operations of forming an improved and compacted ground wall 1A in this way is carried out as part of an overall sequence involving the moving up of the cutter A.

Figures 5, 6, 7, 8A, 8B, 8C, 8D:
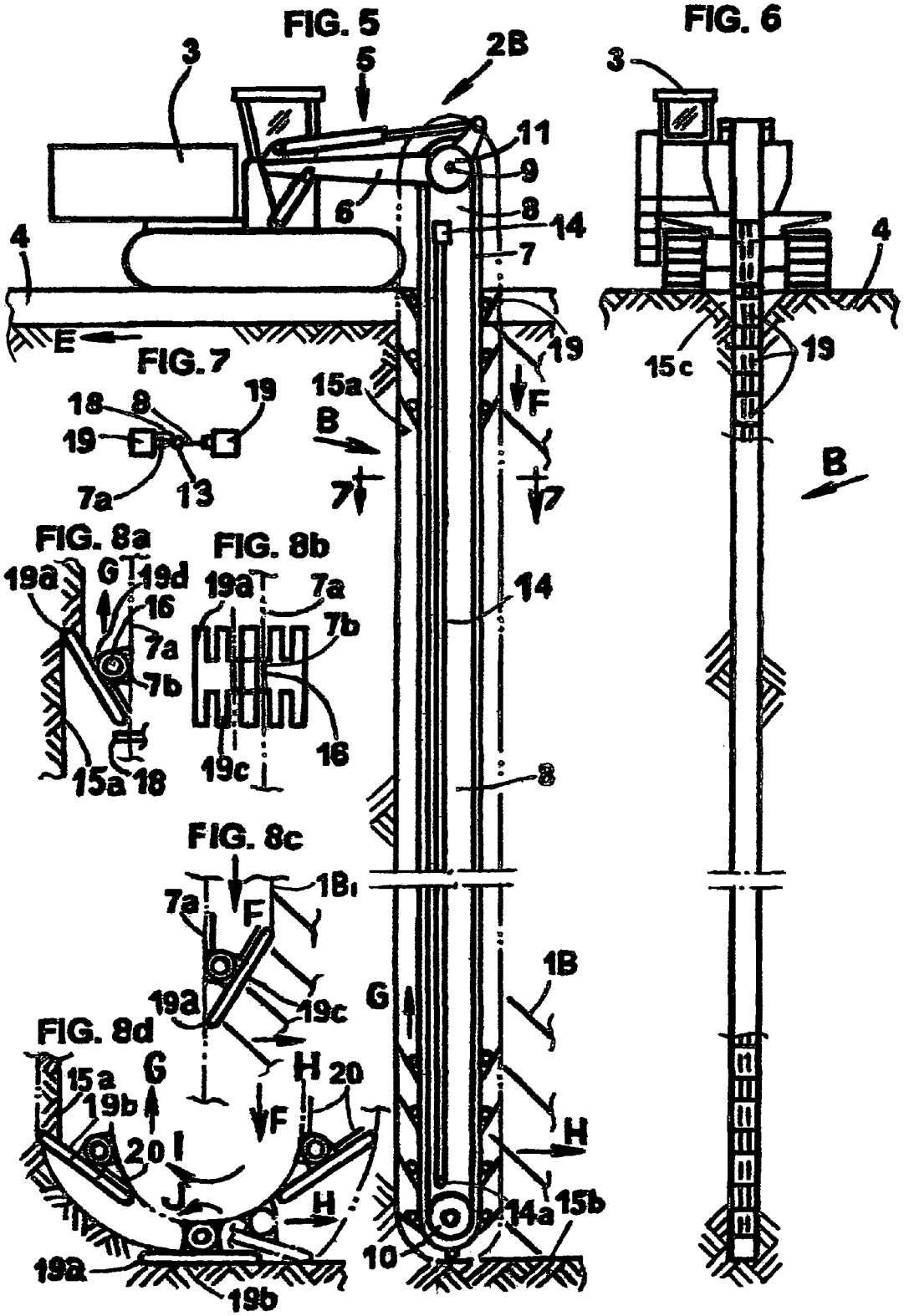
FIG. 5 is a side view of a second preferred embodiment of the excavator according to the invention.
FIG. 6 is a view from the rear of the excavator shown in FIG. 5.
FIG. 7 is a cross-sectional view taken on line 7-7 of the endless chain cutter of the excavator shown in FIG. 5.
FIGS. 8*a*, 8*b*, 8*c* and 8*d* are side, from the rear in a front compressing operative position, side in a rear compressing operative position and at movement from the rear position into the front position views on a slightly increased scale relative to FIGS. 5 to 7 of one example of a compressor slider used in the endless chain cutter of the excavator shown in FIGS. 5 to 7 according to the invention, respectively.

The embodiment 2B of the excavator 2 as shown in FIGS. 5, 6, 7, 8*a*, 8*b*, 8*c* and 8*d* for constructing an underground continuous compacted ground wall 1B which is similar in filler materials to the wall 1A, that is preferably partly similar in construction to the excavator 2A and comprises an endless chain cutter B which is similar partly in construction to the cutter A and comprises a number of ground 4-cutting, earth- and wall face $1B_1$-compressing, cutter and compressor sliders 19 fixed to the chain 7 as shown in FIGS. 5 to 7 and 8*a* to 8*d* that are similar partly in construction to the sliders 13. A means for driving the sliders 19 comprises a spiral screw return spring 20 placed co-axially on the pin 16 and connected with one its distant end to the chain link 7*a* and with other its distant end to the slider 19 remotely from the axis of the pin 16 for producing the turning movement of the slider 19 about the axis of the pin 16, when the slider 19 being above the ground 4 and unloaded, from a ground 4-cutting and filling of the earth-compressing, front operative position as shown in FIGS. 5 and 8*a* to 8*c* at ahead of the chain 7 and relative to a supporting chain link 7*a* as shown in FIGS. 8*a* and 8*b* in a direction shown by an arrow L in FIG. 8*d* between limit stops (not shown) into a rear, face $1B_1$-compressing operative position at behind closely the guide post 8 as shown in FIG. 8*c*. The spring 20 is capable of keeping the slider 19 in the face-compressing position against the resistance of the face $1B_1$ and permits the turning of the slider 19 from the face-compressing position into the cutting and filling-compressing position.

One example of arrangements of the sliders 19 is shown in FIGS. 8*a*, 8*b*, 8*c* and 8*d*. Each of the sliders 19 has a sharpened cutting edge 19*a* for excavating the ground 4 in a direction shown by an arrow J in FIGS. 5, 8*a* and 8*d* and for scraping a filling of the earth in the excavated section 15 in a direction shown by an arrow I in FIGS. 5 and 8*c* and a front compressing slider facet portion 19*b* as shown in FIGS. 8*c* and 8*d* capable of being oriented in the direction I and in a direction shown by an arrow K shown in FIG. 8*c* for forcing a mixture of the earth and a running improving material in the direction K and compressing on the face $1B_1$, where the portion 19*b* being positioned in the face-compressing operative position at the back angle in relation to the direction I; an oriented in the directions J and K rear compressing slider facet portion 19*c* as shown in FIGS. 8*a*, 8*b* and 8*d* for forcing the earth and the improving material in the direction K toward the face $1B_1$, where the portion 19*c* being positioned in a cutting and filling and filling-compressing operative position at the back angle in relation to the direction J. Each of the sliders 19 is shaped into an agitator comb as shown in FIG. 8*b*. A number of agitator bars 18 are fixed on and perpendicularly to faces of the guide post 8 with the ability to pass through comb hollows of the sliders 19. The sliders 19 and the bars 18 being capable of agitating the earth and a running improving material being injected through the injection pipe 14 into the section 15 to mix them together.

In operation, each of the sliders 19 is capable of being forced into interaction with a front working facial wall 15*a* of an excavated section 15, excavate the ground 4 and filling the section 15 with the earth in the section 15, forcing the earth on the portions 19*b* and 19*c* in the direction K to the face $1B_1$ of the wall 1B being formed and compressing on the face $1B_1$. As each of the sliders 19 moves with the chain 7 in the direction J in FIGS. 5 and 8*a* by the drive means 9 and being kept in the cutting and compressing operative position as shown in FIGS. 5, 8*a* and 8*d* by the resistance of the wall 15*a* and against the resistance of the spring 20 and a limit stop such as an edge of an endless chain link 7*a*, the section 15 will be formed as the ground 4 is excavated from the wall 15*a*, and the section 15 will be filled with the earth, and the ground wall 1B will be formed as the filling of the earth is forced in the direction K past and to behind the guide post 8 and compressed on the face $1B_1$. When each of the sliders 19 comes to above the ground 4, the spring 20 forces the unloaded slider 19 to turn about the axis of the pin 16 from the first limit stop and the cutting and compressing position up to the second limit stop into the compacting position as shown in FIGS. 8*c* and 8*d* and urges the slider 19 to be kept in latter against the resistance of the soft face $1B_1$ before it has hardened. Then, as each of the sliders 19 moves in the direction I as shown in FIGS. 5 and 8*c*, the filling of the earth on the slider 19 is scraped from at behind the guide post 8, forced in the direction K and compressed on the face $1B_1$. When each of the sliders 19 reaches the bottom 15*b* of the section 15 and is forced simultaneously by the endless chain 7 in the direction L in FIG. 8*d* and by the bottom 15*b* and then the wall 15*a* in a direction shown by an arrow M in FIG. 8*d*, the slider 19 will be turn about the axis of the pin 16 from the compacting position represented in FIGS. 5, 8*c* and 8*d* against the resistance of the spring 20 into the cutting and compressing position represented in FIGS. 5, 8*a* and 8*d* up to the limit stop. Thereafter, each of the sliders 19 is being kept in the cutting position by the drive motor 9, the wall 15*a* and the limit stop. A ground filling-improving material such as a hardening sealing clay fluid or a cement milk and the like can be injected through the injection pipe 14 in the section 15 to be agitated and mixed with the earth by means of the sliders 19 and the bars 18 to form a compacted and improved ground wall 1B. The drive motor 9 with the sliders 19 can be used to assist the chassis 3 in moving up the guide post 8. The operations of compressing an improved ground filling to form a compressed improved ground wall 1B in this way is carried out as part of an overall sequence involving the movement of the cutter B.

Figures 9A, 9B, 10, 11, 12:
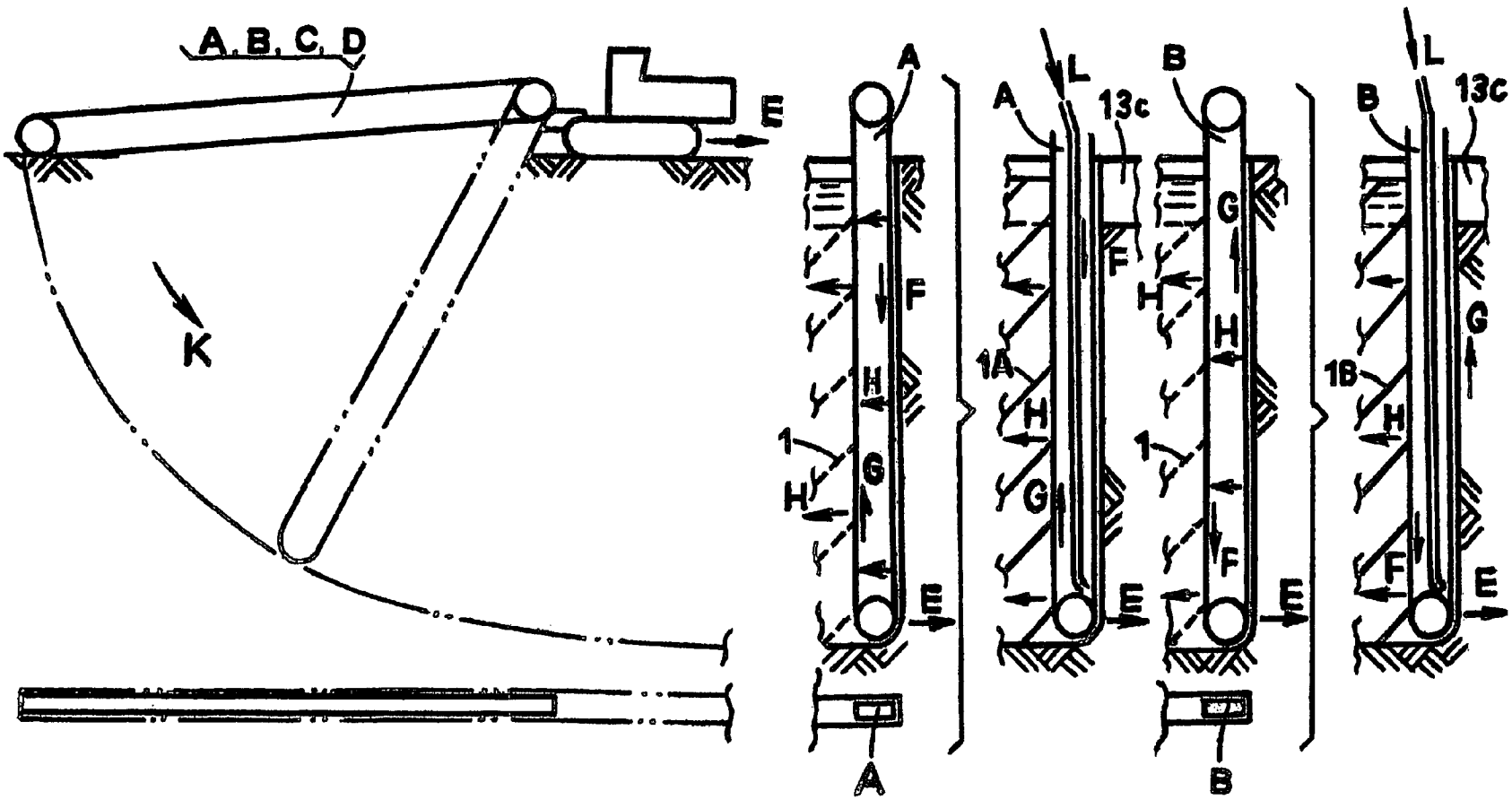
FIG. 9*a* is a view illustrating the process of the construction methods according to the invention with using the excavators shown in FIGS. 1 to 8, 13, 14, 16, 17, 20-22, 24-27, 29-34.
FIG. 9*b* is a view illustrating the processes of the first construction method according to the invention with using the excavator shown in FIGS. 1 to 4*d;*
FIG. 10 is a view illustrating the processes of the second construction method according to the invention with using the excavator shown in FIGS. 1 to 4*d;*
FIG. 11 is a view illustrating the processes of the first constructing method according to the invention with using the excavator shown in FIGS. 5 to 8*d;*
FIG. 12 is a view illustrating the processes of the second construction method

In constructing an underground, continuous, compacted improved ground wall 1A or 1B by using the corresponding excavator 2A or 2B constructed described above, the endless chain cutter A or the endless chain cutter B is assembled into the desired length and placed on the ground 4 as shown in FIG. 9*a* or in an excavated ditch section 15*c* shown in FIG. 6 that is dug previously in the ground 4 to predetermined depth and width in the section 15*c* where the wall 1A or 1B is to be formed by means of an excavating device such as a plough ditcher (not shown). Thereafter, the endless chain 7 of the endless chain cutter A or B is driven by means of the drive motor 9 in the intended directions I and J shown in FIGS. 1 and 5, the cutter A or B inserts into the section 15*c* and the ground 4 and tilts about the chassis 3 in a direction shown by an arrow N in FIG. 9*a* into an intended inclined up to about 60° relative to the horizontal plane or vertical preferably operative position as shown in FIGS. 1 and 5, while the chassis 3 is advanced in a direction shown by an arrow H in FIGS. 1 and 5 to form a continuous groove in the ground 4.

FIGS. 9*a* and 9*b* illustrate the first construction method according to the invention by the use of the endless chain cutter A and FIGS. 9*a* and 11 illustrate that first method by the use of the endless chain cutter B. First, an upper ditch section 15*c* of an excavated section 15 is dug in the ground 4 to a predetermined depth and width by means of an excavated device such as a known plough ditcher (not shown). The cutter A of the excavator 2A or the cutter B of the excavator 2B is then inserted into the ditch section 15*c*. Thereafter the endless chain 7 is driven in the predetermined directions shown by arrows I and J in FIGS. 1 and 5 and the chassis 3 is driven in the predetermined direction shown by an arrow H in FIG. 9*a* to excavate the ground 4. As a result, a front working face $1A_1$ of a mixed ground filling or an improved mixed ground filling 1A that is compressed to form a compacted, mixed or improved ground wall 1A or 1B and a surplus portion of the ground filling is forced into the ditch section 15*c* to form a head of the compacted ground wall 1A or 1B. The drive means 9, the endless chain 7 and the sliders 13 or 19 of the excavator 2A or 2B are capable of assisting the chassis 3 to advance up the guide post 8.

FIGS. 9*a*, 10 and 12 illustrate the second construction method according to the invention by the use of the excavator 2A or the excavator 2B. First, an upper ditch section 15*c* of an excavated section 15 is dug in the ground 4 to a predetermined depth and width in the section 15*c* by means of an excavating device (not shown) such as a plough ditcher and the like. The endless chain cutter A of the excavator 2A or the endless chain cutter B of the excavator 2B according to the invention is then inserted into the ditch section 15*c*. Thereafter the chassis 3 is driven in the predetermined direction shown by an arrow H and the endless chain 7 is driven in the predetermined direction shown by arrows I and J in FIGS. 10 and 12 to excavate the ground 4, while a running, earth-improving material such as hardening cement milk or sealing clay fluid is jetted into the excavated section through the injection pipe 14 provided in the guide post 8 of the cutter A or the cutter B as shown by an arrow O in FIGS. 10 and 12. As a result, a front working face $1A_1$ or $1B_1$ of a ground filling is formed and compressed to form an improved and compacted ground wall 1A or 1B and a surplus portion of the ground filling is forced into the section 15*c* to form a head of the compacted ground wall 1A or 1B.

In the illustrated embodiment 2C of the excavator 2 as shown in FIGS. 13 and 14 that is partly similar in construction to the excavator 2B and comprises the chassis 3, the framework 5, the frame 6, an endless chain cutter C that is partly similar in construction to the cutter B as shown in FIGS. 5 to 8*d* and comprises the endless chain 7 movable together with the chain sprocket 10, a number of the cutter and compressor sliders 19 supported pivotally on the chain 7 about the generally horizontal axes of the pins 16 and provided with the return springs 20, and a number of elongate partition members 22 arranged along the length of the guide post 8 across the excavated section 15, provided on their edges with a known resilient packing (not shown) engaging on side walls of the section 15 for sealing the small gapes between the edges and the side walls and adapted to guide the earth being removed upwardly at ahead of the members 22 and a filling of a ready filler material such as sand or a cement concrete being poured downwardly into the section 15 behind the members 22 and supported by the member 22. A forward oriented, in relation to a direction shown by an arrow I in FIG. 13, sharpened edge of the slider 19 is capable of scraping the ready filling from at behind the member 22, the backward oriented, compressing slider facet portion 19*b* is capable of displacing the ready filling in the direction I toward the bottom 15*b* of the section 15 and in a direction shown by an arrow K in FIG. 13 on a front working face $1C_1$ of a compacted ready filling, underground continuous wall 1C to compact the face $1C_1$ and form the wall 1C from its lower portion, the lower portion being at behind and below a lower end of the member 22.

In operation, when each of the sliders 19 moves at ahead of the member 22 in the direction J in FIG. 13 and engages on the front facet portion of the member 22, the filling of the earth is scraped from the front facet portion of the member 22 and removed in the direction J in FIG. 13. Each of the sliders 19 when moves in the direction I in FIG. 13 and engages on the rear facet portion of the member 22, supports the face $1C_1$, scrapes and displaces the ready filling in the direction I toward the bottom 15*b* and forces the ready filling against the bottom 15*b* and in the direction K in FIG. 13. When the slider 19 moves in the cutting and removing position at ahead of the member 22, the earth is scraped from the front facet of the member 22 and removed in a direction shown by an arrow J in FIG. 13.

In constructing an underground continuous compacted ready filling wall 1C by the use of the excavator 2C constructed described above, the endless chain cutter C having a desired length is assembled and placed on the ground surface as shown in FIG. 9*a*. Thereafter, the endless chain 7 of the cutter C is driven in directions shown by arrows I and J shown in FIG. 13, while the chassis 3 is advanced in the direction shown by an arrow H in FIG. 13, the cutter C inserts into the ground 4 in a direction shown by an arrow N in FIG. 9*a* and tilts about the frame 6 up to a predetermined depth to form a continuous groove in the ground 4.

Figure 15:
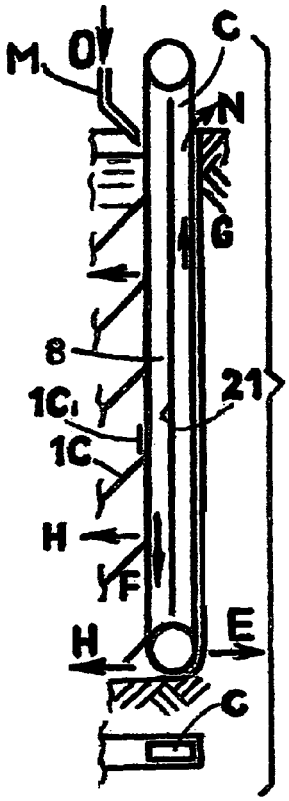
FIG. 15 is a view illustrating the processes of the third construction method according to the invention with using the excavator shown in FIGS. 13 and 14.

FIGS. 9*a* and 15 illustrate the third construction method according to the invention by the use of the excavator 2C. The endless chain cutter C of the excavator 2C according to the invention that is provided with the partition member 22 and the sealing resilient packings and positioned on the ground 4. Thereafter the chassis 3 is driven in the predetermined direction shown by an arrow H in FIG. 15 to excavate the ground 4 and remove the earth as shown by an arrow P in FIG. 15, while an injection pipe Q is inserted at behind the member 22 and the sealing packings and a ready filler such as sand or a hardening cement concrete is poured through the injection pipe Q into the excavated section as shown by an arrow R in FIG. 15. As a result, the excavated section is filled with the ready filler to form a ready filling, a front working face $1C_1$ of the ready filling is compressed from its lower portion to form a compacted ready filling wall 1C from its lower portion. The drive motor 9 and the sliders 19 can be used to assist the chassis 3 in moving up the guide post 8 in the excavated section before the face $1C_1$ of the wall 1C has hardened.

The illustrated embodiment 2D of the excavator 2 as shown in FIGS. 16, 17, 17*a* and 17*b* that is partly similar in construction to the excavator 2C and comprises the chassis 3, the framework 5, the frame 6 and an endless chain cutter D that is partly similar in construction to the cutter C as shown in FIGS. 13 and 14 and comprises the endless chain 7, the guide post 8, a number of known cutter members (not shown) for excavating the ground 4 and form the excavated section 15 and a number of compressor sliders 21 fixed to the chain 7, an elongated, earth-guiding partition member 22 extending along the length and perpendicularly to a central longitudinal surface of and fixed rigidly to the guide post 8, a known sealing means such as resilient packings (not shown) provided on edges of the member 22 and engaging on the adjacent region of the side walls for sealing small gaps between side edges of the member 22 and adjacent region of trench side walls. Each of the sliders 21 (shown better in FIGS. 17*a* and 17*b*) has an outwardly and aside oriented edge for engaging on the facial wall 15*a* and side walls of the section 15, an oriented inwardly edge for engaging on a front facet portion of the member 22, and an earth- and face-compressing, slider-shaped facet portion, is fixed to a link 7*a* of the chain 7 and positioned at the back angle relative to the chain 7 and a direction of longitudinal displacement as shown by an arrow J in FIG. 16. A plurality of the agitator bars 18 as shown in FIG. 14*a* are extended into crossing with the sliders 21, and each of the sliders 21 is shaped into an agitator comb having cuts for passing the bars 18 for agitating a filling of the earth and the improving material to mix them together ahead of the member 22.

In operation, the member 22 when is inserted into the excavated section 15 that is capable of guiding the earth being forced by the compressor sliders 21 downwardly in a direction shown by an arrow I in FIG. 16, 22 to a lower portion of the face $1D_1$ and each of the sliders 21 is capable of forcing the earth at ahead of the member 22 downwardly in the direction I, agitating the earth filling to be mixed with the improving material, and forcing a mixture of the earth and the improving material in a direction shown by an arrow M in FIG. 16 into between a lower end of the member 22 and the bottom 15*b* and on a lower portion of the face $1D_1$ so that the section 15 at behind the member 22 that will be filled with the mixture from its lower portion and the mixed filling will be compacted.

Thereafter, when the slider 21 being displaced at behind the member 22 in the direction J it is capable of being forced into engagement on a rear facet portion of the member 22, the side walls and the face $1D_1$ and into interaction with the filling at behind the member 22 and will scrape the filling from the rear facet portion in the direction K and compress on the face $1D_1$ to advance and compact the improved ground wall 1D. Then the slider 21 is capable of being displaced through above the ground 4 to repeat the operations of compressing the filling on the face $1D_1$ in this way as part of a sequence involving the moving of the cutter D.

In constructing an underground continuous compacted ground wall 1D by the use of the excavator 2D constructed described above, the endless chain cutter D having the desired length is assembled and placed on the ground surface as shown in FIG. 9*a* or inserted into a ditch section 15*c* of an excavated section 15 dug previously in the ground 4 by means of an excavating device (not shown) such as a plough ditcher at a position where the wall 1D is to be formed. Thereafter, the endless chain 7 of the cutter D is driven by means of the motor 9 in the directions I, M and J shown in FIG. 13, while the chassis 3 is driven to advance in the direction H to form a continuous groove in the ground 4. The motor 9 and the sliders 21 can be used to assist the chassis 3 in moving up the guide post 8.

Figure 18:
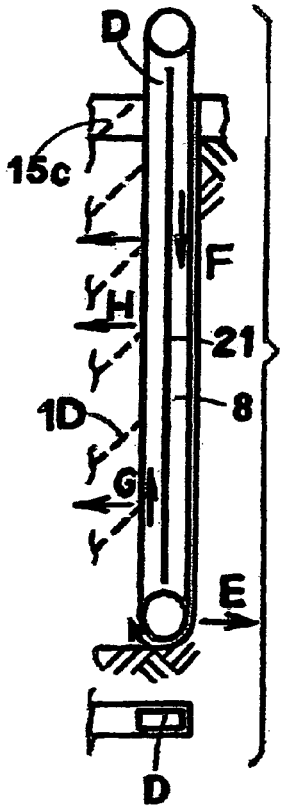
FIG. 18 is a view illustrating the processes of the first construction method according to the invention with using the excavator shown in FIGS. 13 and 14.

FIGS. 9*a* and 18 illustrate the first construction method according to the invention with using the excavator 2D. The endless chain cutter D of the excavator 2D according to the invention is inserted into a ditch section 15*c* dug previously in the ground 4 to a predetermined depth, width and length by means of an excavating device (not shown) such as a plough ditcher. Thereafter the chassis 3 is driven in the predetermined direction shown by an arrow H in FIG. 9*a* to excavate the ground 4 in a direction shown by an arrow N. As a result, a front working face $1D_1$ of the filling is formed and compressed from its lower portion to form a compacted mixed ground wall 1D and a surplus portion of the mixed ground filling is displaced into the ditch portion 15*c* to form a head of the wall 1D.

Figure 19:
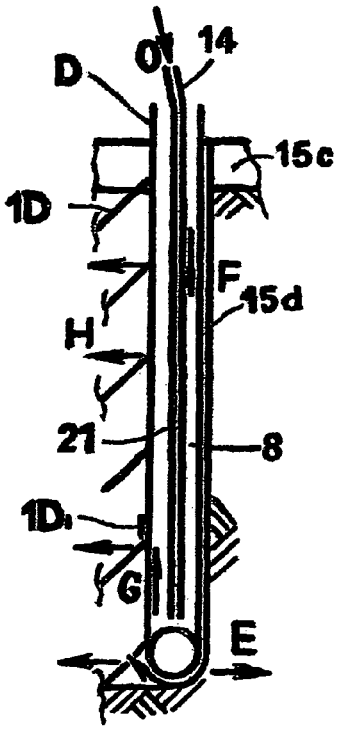
FIG. 19 is a side view illustrating the processes of the second construction method according to the invention with using the excavator shown in FIGS. 16 to 17*b;*

FIGS. 9*a* and 19 illustrate the second construction method according to the invention with using the excavator 2D. First, an upper ditch section 15*c* of an excavated trench 15 is dug in the ground 4 to a predetermined depth, width and length by means of a excavating device (not shown) such as a plough ditcher as shown in FIG. 18. The endless chain cutter D of the excavator 2D according to the invention is then inserted into the ditch section 15*c*. Thereafter the chassis 3 is driven in the predetermined direction shown by an arrow H in FIG. 9*a* to excavate the ground 4, while a running, ground filling-improving material such as clayey fluid is jetted into the excavated section through the injection pipe 14 provided in the partition member 22 of the cutter D as shown by an arrow O in FIG. 19. As a result, a front working face $1D_1$ of the improved ground filling is compressed from its lower portion to form an improved and compressed ground wall 1D and a surplus portion of the improved ground filling is displaced into the ditch section 15*c* to form a head of the wall 1D. The drive motor 9, the endless chain 7 and the sliders 21 before the improved ground wall 1D has hardened that can be used to assist the chassis 3 in moving up the guide post 8.

In the illustrated embodiment 2E of the excavator 2 shown in FIGS. 20 to 22, the excavator 2E is partly similar in construction to the endless chain excavators 2A and 2B and provided with the shown in FIG. 1 movable chassis 3, the framework 5 including the upper tiltable frame 6 and the lower tiltable frame shaped into a vertically preferably disposed, elongate guide post 23 supported pivotally at its upper portion by the frame 6, a drive means such as a hydraulic power motor 24 having an output shaft (not shown) to which a chain driving wheel 25 is connected, a chain sprocket 26 rotatably supported on a lower end of the guide post 23 by means of a pivotal pin 27, an endless chain 28 extended around the driving wheel 25 and the chain sprocket 26, a number of cutter bits 28*a* fixed to the chain 28 to form an endless chain cutter E. To compress a working end face $1E_1$ of an underground continuous filling wall 1E being formed with a running filler material such as cement concrete and the like in the section 15 being excavated, the excavator 2E is provided with a vertically preferably disposed, filling 1E-forming and filling wall face $1E_1$-compressing, shield-shaped injection pipe 29 extending from the framework 5 down at behind and along the length of an underground portion 23*a* of the guide post 23 and across the section 15. The small gaps between side edges of the injection pipe shield 29 and side walls of the section 15 that are sealed with known resilient packings 30 fixed on sides of the pipe shield 29 and engaging on the side walls to prevent the loss of the filler mortar with the endless chain cutter E from the face $1E_1$. The pipe shield 29 is supported at its underground portion on an underground portion of the guide post 23 by a pivotal connecting means for forward and backward oscillation about a generally horizontal shield pivotal axis, where the shield pivotal axis being within underground portions of the guide post 23 and pipe shield 29 and perpendicular to a central longitudinal plane of the pipe shield 29. The shield pivotal means includes a bearing means comprising a bearing element such as a vertically-disposed, ski-shaped underground portion 23*a* of the guide post 23 that extended downward in a direction shown by an arrow I in FIG. 22 and backward in a direction shown by an arrow K in FIG. 22, a plurality of bearing members such as lugs distributed co-axially and transversally within the widened portion 23*a*, a plurality of bearing members such as lugs distributed co-axially and transversally within the transversally widened pipe shield 29, and an elongated bearing part such as a pivotal pin 31 being co-axial with the shield pivotal axis, and being configured to allow limited oscillation of the pipe shield 29 relative to the guide post 23 about the shield pivotal axis. The pipe shield 29 has preferably a <-shaped central longitudinal axis with a forward oriented vertex on the shield pivotal axis. The central longitudinal plane of the cutter E crosses the advancing direction H, the direction H being on the central longitudinal plane of the pipe shield 29, at a determined angle, the angle being equal to about 98-99°, preferably 99° so that the post portion 23*a* extends aside and past closely, with a clearance, cutter bits 28*a*, where each of the known cutter bits 28*a* is capable of being forced into interaction with the wall 15*a* to urge the cutter E in a lateral direction crossing the planes toward the direction H. There it is possible to use two endless chain cutter E disposed adjacently in the arrow-shaped mirror order.

The drive means for effecting the alternating forward and backward oscillation of the pipe shield 29 about the pipe shield pivotal axis that consists in part of a motive power unit such as a double-acting hydraulic cylinder and piston unit 32 pivotally secured from the rear to the guide post 23 and connected via a linkage or bracket to the pipe shield 29. The pipe shield 29 has an orifice 29*a* located between the ground level and the pivotal axis of the pin 31 and provided with a check valve 33 capable of opening by means of pressure and weight of the liquid mortar which being located above and injected in the section 15 and closing by pressure of the liquid mortar being compressed on an upper portion of the face $1E_1$ by an upper, chute-shaped, open, compressing portion 29*b* which being below the valve 33 and above the axis of the pin 31, a middle portion 29*c* which being at below the axis of the pin 31 and provided with a check valve 34 capable of opening by means of pressure of the liquid mortar located above and being injected in the section 15 and closing by aid of pressure of the mortar being compressed on a lower compressing portion 29*d* of the pipe shield 29 being below the axis of the pin 31 to prevent return flow of the liquid mortar into the pipe shield 29 and in the direction J, when the mortar is compressed by means the compressing shield portion 29*d* on a lower portion of the face $1E_1$, and an extending horizontally, upper wall face-supporting ski means 35 that is connected to an upper portion of the pipe shield 29 and engaged on an upper region of the side walls of the section 15 and seals the upper region the section 15.

In operation, as the face-compressing, injection pipe shield 29 with the packings 30 is advanced with the guide post 23 in the excavated section 15 and the guide post 23 is drawn up with the framework 5, the filler mortar can be poured through the pipe shield 29 and open the check valves 33 and 34 so that the section 15 will be filled with the mortar and the wall 1E will be formed. The packings 30 slide on the bottom 15*b* and the side walls of the section 15 so as to locate between the cutter E and the face $1E_1$, and the ski means 35 supports the upper working face $1E_2$ of the wall 1E so that an upper section of the wall 1E which being formed and compressed that will be closed off in relation to its exterior and prevented against the removal and soiling with the earth. As the oriented in a direction shown by an arrow K in FIG. 20 compressing back portions 29*b* and 29*d* of the pipe shield 29 swing about the pivotal axis of the pin 16 backward in the direction K and forward in a direction shown by an arrow H in FIG. 20, the wall 1E will be formed as the mortar is poured through the pipe shield 29 and opens the check valves 33 and 34 and fills the section 15 being formed, and the face $1E_1$ will be compressed as the mortar on the compressing shield portions 29*b* and 29*d* is agitated and forced in the direction K and compressed on the face $1E_1$ thereof. When the upper compressing shield portion 29*b* moves in the direction K and the lower compressing shield portion 29*d* moves in the direction H about the axis of the pin 31, the portion 29*b* compresses the mortar which being within the portion 29*b* in the direction K on the upper portion of the face $1E_1$ and on the check valve 33 to close, and forces the mortar down through a middle portion of the pipe shield 29 past the pin 31 to open the check valve 34 into the lower portion of the section 15, while the portion 29*d* retreats from a lower portion of the face $1E_1$ being below the axis of the pin 31 and forms a lower gap between the lower portion of the face $1E_1$ and the portion 29*d* so that the mortar is sucked from the open valve 34 into the lower gap and fills the lower gap and forms a lower portion of the wall 1E. When the upper portion 29*b* moves in the direction H and the portion 29*d* moves in the direction K about the axis of the pin 31, the portion 29*d* forces the mortar in the direction K and compresses on the lower portion of the face $1E_1$, and the mortar forces and closes the check valve 34, while the upper portion 29*b* retreats from the upper portion of the face $1E_1$ and forms an upper gap between the upper portion of the face $1E_1$ and the portion 29*b* so that the mortar is sucked from the upper portion 29*a* and forces and opens the check valve 33 and is poured through the check valve 33 into the upper gap and fills the upper gap and an upper portion of the wall 1E will be formed.

In constructing an underground continuous compacted filling wall 1E by the use of the excavator 2E constructed described above, the endless chain cutter E having the desired length is assembled and placed on the ground surface as shown in FIG. 9*a* at a position where the wall 1E is to be formed. Thereafter, the endless chain 28 of the cutter E is driven by means of the motor 24 in directions shown by arrows I and J in FIG. 20, while the chassis 3 is advanced in the direction H to form a continuous groove of the intended depth in the ground 4.

Figure 23A:
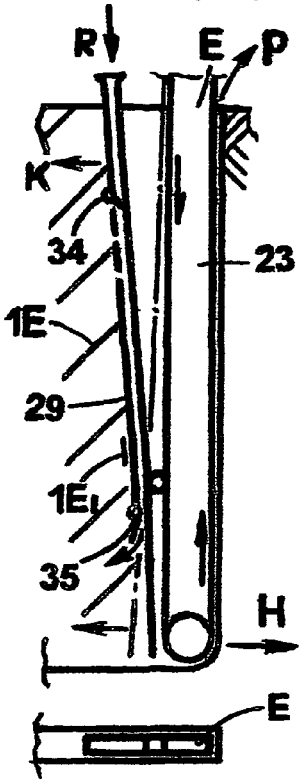
FIGS. 23*a* and 23*b* are views illustrating the processes of the third construction method according to the invention with utilizing the excavator shown in FIGS. 20-22.
Figure 23B:
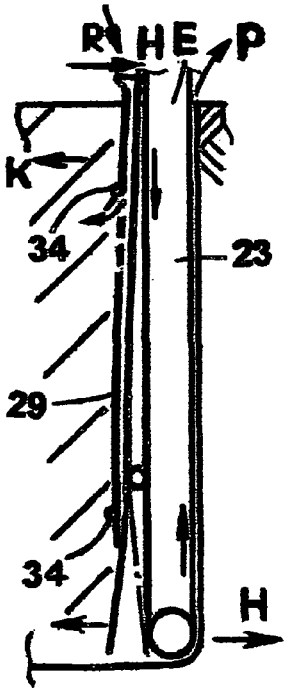

FIGS. 9*a*, 23*a* and 23*b* illustrate the third construction method according to the invention by the use of the excavator 2E. The endless chain cutter E of the excavator 2E according to the invention is assembled and placed into a horizontal starting position represented in FIG. 9*a* on the ground 4 where the underground continuous wall 1E is to be formed. Thereafter, the chassis 3 is driven in the predetermined direction shown by an arrow H in FIG. 9*a* to excavate the ground 4 and remove the earth as shown by an arrow P in FIG. 23*a*, while an injection and compressor, pipe shield 29 provided in the cutter E that is inserted into the excavated section and a running filler material such as hardening cement concrete or mortar is poured in the section through the injection pipe shield 29 as shown by an arrow R in FIGS. 23*a* and 23*b*. As a result, the excavated section is filled with the ready filler material to form a ready filling, a working front face $1E_1$ of the ready filling is compressed to form a compacted ready filling wall 1E.

FIGS. 9*a*, 23*a* and 23*b* illustrate also other construction method according to the invention by the use of the excavator 2E. First, an agitator and compressor (not shown) is prepared, which is substantially similar in construction to the endless chain cutter E and provided with an agitator and compressor shield 29. The cutter E of the excavator 2E according to the invention is placed on the ground 4. Thereafter, the chassis 3 is driven in the predetermined direction shown by an arrow H in FIG. 9*a* to excavate the ground 4 in a direction shown by an arrow N in FIG. 9*a* and the arrow H and to remove the earth as shown by an arrow P in FIG. 23*a*, while the agitator pipe shield 29 which is substantially similar in construction to the compressor pipe shield 29 that is inserted behind the cutter E and a ready filler such as cement concrete or mortar is poured through the injection pipe provided in the agitator pipe shield 29 as shown by an arrow R in FIG. 23 and the agitator 29 is driven in the directions shown by the arrows H and K. As a result, the excavated section is filled with the ready filler to form a ready filling, a front working face $1E_1$ of the ready filling is compressed to form a compacted ready filling wall 1E as shown in FIGS. 23*a* and 23*b*.

The hydraulic unit 32, the pipe shield 29 and the sealing packings 30 can be used to assist the chassis 3 in moving up the guide post 8 in the excavated section before the face $1E_1$ has hardened. The bearing element of the underground portion 23*a* of the guide post 23 can be used to support other face-compressing means according to the invention, such as rotating screw spiral compressors (later described).

An embodiment 2F of the excavator 2 as shown in FIGS. 24 to 27*a* that is partly similar in construction to the excavators 2D and 2E and comprises the chassis 3, the framework 5 including the upper tiltable frame 6 and the lower tiltable frame shaped into a vertically preferably disposed, elongate guide post 36 of an endless chain cutter F, a hydraulic preferably power motor 37 supported on a saddle (not shown) and having a shaft (not shown), a chain sprocket 38 rotatably supported on a lower end of the guide post 36 by means of a pin 39, a chain driving wheel 40 connected to the shaft of the motor 37, an endless chain 41 extending around the chain sprocket 38 and the driving wheel 40, a number of cutter bits 42 fixed to the endless chain 41 to form the endless chain cutter F, an elongate, shaped into a two-support beam, shield 43 for supporting a front working face $1F_1$ of an underground, continuous compacted ready filling wall 1F and a means for compacting the wall 1F such as the above-mentioned, agitator, compressor and shaped into an injection pipe, shield 29 or rotating screw spiral compressor (later described). The shield 43 is supported at its upper end preferably on an upper portion of the guide post 36 located above the ground 4, extended down at behind closely the cutter F into and across the excavated section 15 and supported at its lower portion on an underground portion of the guide post 36. A head of the section 15 and a small gap between the shield 43 and a bottom and side walls of the section 15 are sealed with a sealing means 44 comprising known resilient packings 44*a* provided on shield edges and engaging on the bottom 15*b* and the side walls and a ski-shaped slip cover 44*b* connected from behind to the shield 43 for engaging on the upper region of the side walls. The underground supporting means comprises a number, two preferably, of co-axially disposed and oriented in direction shaped by an arrow K in FIG. 26 and opposite an intended advancing direction shown by an arrow H in FIG. 24, cam wheels 45 rotatably connected by means of a shaft 46 to the underground portion of the guide post 36 and extended on each side of the chain 41 for rotation with the shaft 46 about a generally horizontal cams pivotal axis, where the cams pivotal axis being perpendicular to a central longitudinal plane of the underground portion of the guide post 36. The shaft 46 being cinematically connected to the chain 41 by means of a known mechanical transmission such as an endless chain transmission 47 comprising a second chain driving wheel (not shown) secured co-axially on the sprocket 38, a chain driven wheel (not shown) secured co-axially on the shaft 46, and a second endless chain extending around the second chain driving wheel and the driven chain wheel and being capable of rotating the wheels 45 concordantly with longitudinal displacement of the chain 41. Each of the wheels 45 comprises a number, three preferably, of radial cam portions 45*a* adapted to extend equidistantly from a hub of the wheel 45 and aside the chain 41 and alternately between adjacent cutter bits 42 toward the shield 43 and having the predetermined length and a sliding end lobe. A number, two preferably of forward oriented, in relation to the direction H, cams-supporting, rolls or wheels 48 rotatably connected oppositely the wheels 45 and from the front to the underground portion of the shield 43 by means of pins 49 for step-bearing alternately and uninterruptedly the lobes of the cam portions 45*a*. The wheels 45 and the wheels 48 are capable of being forced into alternate and uninterrupted interaction and the cam portions 45*a* are operable to support continuously and mutually the underground portions of the guide post 36 and the shield 43 by the drive motor 37 capable of rotating the wheels 45 with the endless chain transmission 47 and the wheels 48 with the cam portions 45*a* of the wheels 45.

Figures 24, 25, 26, 27, 27A:
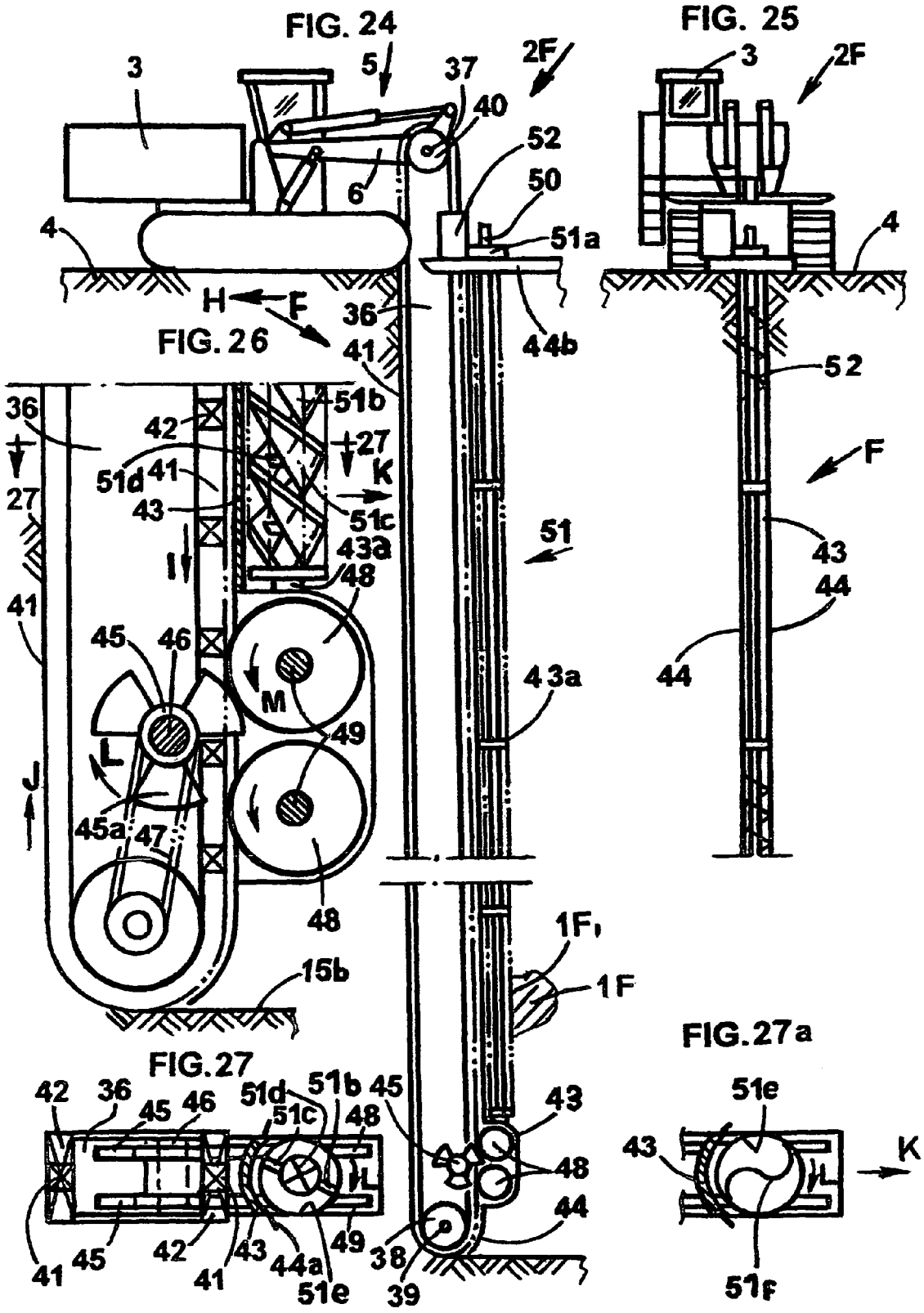
FIGS. 24, 25, 26, 27 and 27*a* are side, from the rear, partly side on a slightly enlarged scale relative to FIG. 24, cross-sectional taken on line 27-27 of FIG. 26 views of sixth preferred embodiment of the excavator according to the invention.

In operation, as the motor 37 rotates the wheels 45 in a direction shown by an arrow L in FIG. 26, the direction L corresponding to the direction I of movement of a backward oriented portion of the chain 41, with the wheel 40 and the chain 41 and the sprocket 38 and the transmission 47, so an advanced cam portion 45*a* performs and ends its way ahead of a cutter bit 42 being moved in the direction I and secures a firm rolling contact with the lower, for example, wheel 48 for supporting mutually the underground portions of the guide post 36 and shield 43, and immediately a next in turn, followed cam portion 45*a* starts its way behind that cutter bit 42 and its firm rolling contact with the upper wheel 48 so that the underground portions of the guide post 36 and shield 43 being further supported mutually and thus all these cam portions 45*a* and wheels 48 will support mutually, alternately and continuously the underground portions of the guide post 36 and shield 43. There it is possible to use the shield 43 to support other compressing means according to the invention, such as spiral screw compressors (later described).

A compressor screw spiral device shown in FIGS. 24-27*a* for the embodiment F it can be used also for filling an excavated section 15 being formed with a running, ready filler material such as a hardening cement concrete or clay mortar and the like. A vertically-disposed, elongate, filling-forming, screw spiral compressor 51 is extending at behind and along the length of the supporting shield 43 down from an injection pipe 50 having a lower end opening at an upper underground portion of the shield 43 that is shaped co-axially, relative to a generally vertical central longitudinal axis of the screw compressor 51, the screw compressor axis being within a central longitudinal plane of the endless chain cutter F, with the ability to rotate about the screw axis by a power drive means such as a hydraulic preferably motor 52 having a driving output shaft (not shown). The screw compressor 51 has a co-axially disposed, upper supporting ring member 51*a* connected to the shaft of the motor 52, a number, preferably two spiral screw-shaped, filling-compressor sliders 51*b* and 51*c* fixed at their upper ends on the ring member 51*a*, connected together with a number of distributed downwardly and radially positioned, elongate, agitator planks 51*d* and being supported on the shield 43 for rotation by a bearing means comprising a number of bearing ring members 51*e* fixed co-axially to the sliders 51*b* and 51*c* and the number of co-axial outer bearing bracket ring members of journal holder portions 43*a* distributed downwardly within the length of the shield 43. Coils of the screw sliders 51*b* and 51*c* are positioned at the downward oriented back angle (see above) relative to the screw axis of rotation and generate an axial, injection pipe-shaped channel extending from the framework 5 into inside the sliders 51*b* and 51*c* and through the members 51*a*, 51*e* and 43*a* and the planks 51*d* and having two screw-shaped lateral gaps opening between the sliders 51*b* and 51*c*.

In operation, as the shield 43 with the sealing packings 44 are inserted into the excavated section 15 and drawn with the guide post 36 in the direction H with the framework 5 and the running filler material moves down through the injection pipe 50*a*, the sliders 51*b* and 51*c*, the planks 51*d* and the members 51*a* and 51*e* to a lower end of the compressor 51, a column of the ready filling will be formed inside the sliders 51*b* and 51*c*. As the planks 51*d* are rotated with inner edges of the sliders 51*b* and 51*c* in a direction shown by an arrow L in FIG. 27, the direction L is opposite to the direction of the spiral screws, a column of the ready filling which being within the screw compressor 51 will be agitated and forced axially down in the direction I to the bottom 15*b* and radially outwardly, in relation to the screw axis, and compressed on the face $1F_1$.

In other example according to the invention as shown in FIG. 27*a* a rotating screw compressor device is similar partly in construction to the compressor 51 and comprises a filling-compressing screw slider 51*f* having a filling-compressing facial portion of an equiangular spiral-shaped cross-section, where the angle of the equiangular spiral is equal to the above mentioned back angle and oriented in a direction of rotation as shown by an arrow L in FIG. 27*a*. The slider 51*f* generates an injection channel extending from the lower end of the injection pipe 50 down and opening laterally within the depth of the face $1F_1$. The screw slider 51*e* is able to be mounted to the ring members 43*a*, 51*a* and 51*e* instead of the sliders 51*b* and 51*c*.

In operation, as the ready filler material moves through the injection pipe 50 and the members 43*a*, 51*a* and 43*e* along the equiangular compressor slider 51*f* toward the lower end of the agitator and compressor 51 and the equiangular slider 51*f* rotates about the generally vertical axis of rotation in the direction L in FIG. 27*a*, the ready filler on the compressor slider 51*f* will be forced radially about the vertical axis of rotation to the face $1F_1$ and compressed on the face $1F_1$.

In constructing an underground continuous compacted ready filling wall 1F by the use of the excavator 2F constructed described above, the endless chain cutter F having the desired length is assembled and placed in a horizontal starting position on the ground surface as shown in FIG. 9*a* where the wall 1F is to be formed. Thereafter, the endless chain 41 of the cutter F is driven by means of the hydraulic motor 37 in directions shown by the arrows I and J in FIG. 26 and the sliders 51*b* and 51*c* or the slider 51*f* of the compressor 51 are driven by the motor 52 to rotate about the vertical axis in an intended direction shown by an arrow L in FIG. 27 and opposite to the direction of the spiral screw, while the chassis 3 is advanced in the direction shown by an arrow H in FIG. 24 to form a continuous groove in the ground 4.

Figure 28:
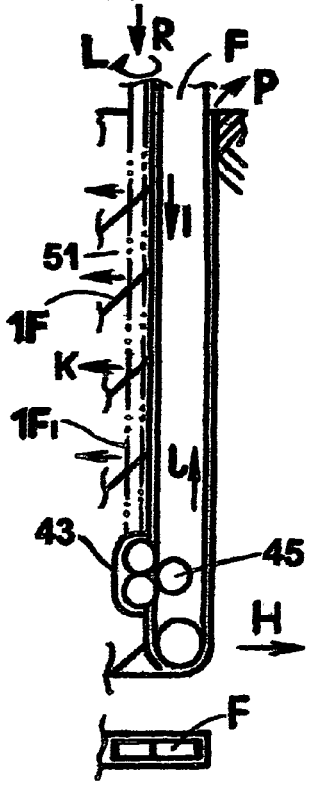
FIG. 28 is a view illustrating the processes of the third construction method according to the invention with utilizing the excavator shown in FIGS. 24-27*a;*

FIGS. 9*a* and 28 illustrate the first construction method according to the invention and using the excavator 2F. The endless chain cutter F of the excavator 2F according to the invention is inserted into a horizontal working position on the ground 4. Thereafter, the chassis 3 is driven in the predetermined direction shown by an arrow H in FIG. 9*a* to excavate the ground 4 and remove the earth as shown by an arrow P in FIG. 28 so that the cutter F is inserted into the ground 4 in a direction shown by an arrow N in FIG. 9*a*, while a running ready filler material is injected into the excavated section through the injection pipe 50 and the compressor 51 in the section as shown by an arrow R in FIG. 28. As a result, the section is filled forcedly with the material and a front working face $1F_1$ of a ready filling is compressed to form a compacted ready filling wall 1F.

FIGS. 9*a* and 28 illustrate also the second construction method according to the invention and using the excavator 2F. First, a compressor (not shown) is prepared, which is substantially similar in construction to the endless chain cutter F and includes a shield 43 and a screw compressor 51. The cutter F of the excavator 2F according to the invention is positioned on the ground 4. Thereafter, the chassis 3 is driven in the predetermined direction shown by an arrow H in FIG. 9*a* so that the cutter F is inserted into the ground 4 in the direction N as shown in FIG. 9*a* and into a vertical preferably operative position to excavate the ground 4 and remove the earth has shown by an arrow P in FIG. 28, while the screw compressor 51 is inserted behind the cutter F and a ready filler material is poured through the screw compressor 51 as shown in FIG. 28 to form a ready filling and a front working face $1F_1$ of the ready filling is compressed to form a compacted ready filling wall 1F.

The motor 52 and the compressor 51 can be used before the face $1F_1$ has been hardened to assist the chassis 3 in moving up the guide post 36.

Figures 29, 30, 31, 32, 33, 34:
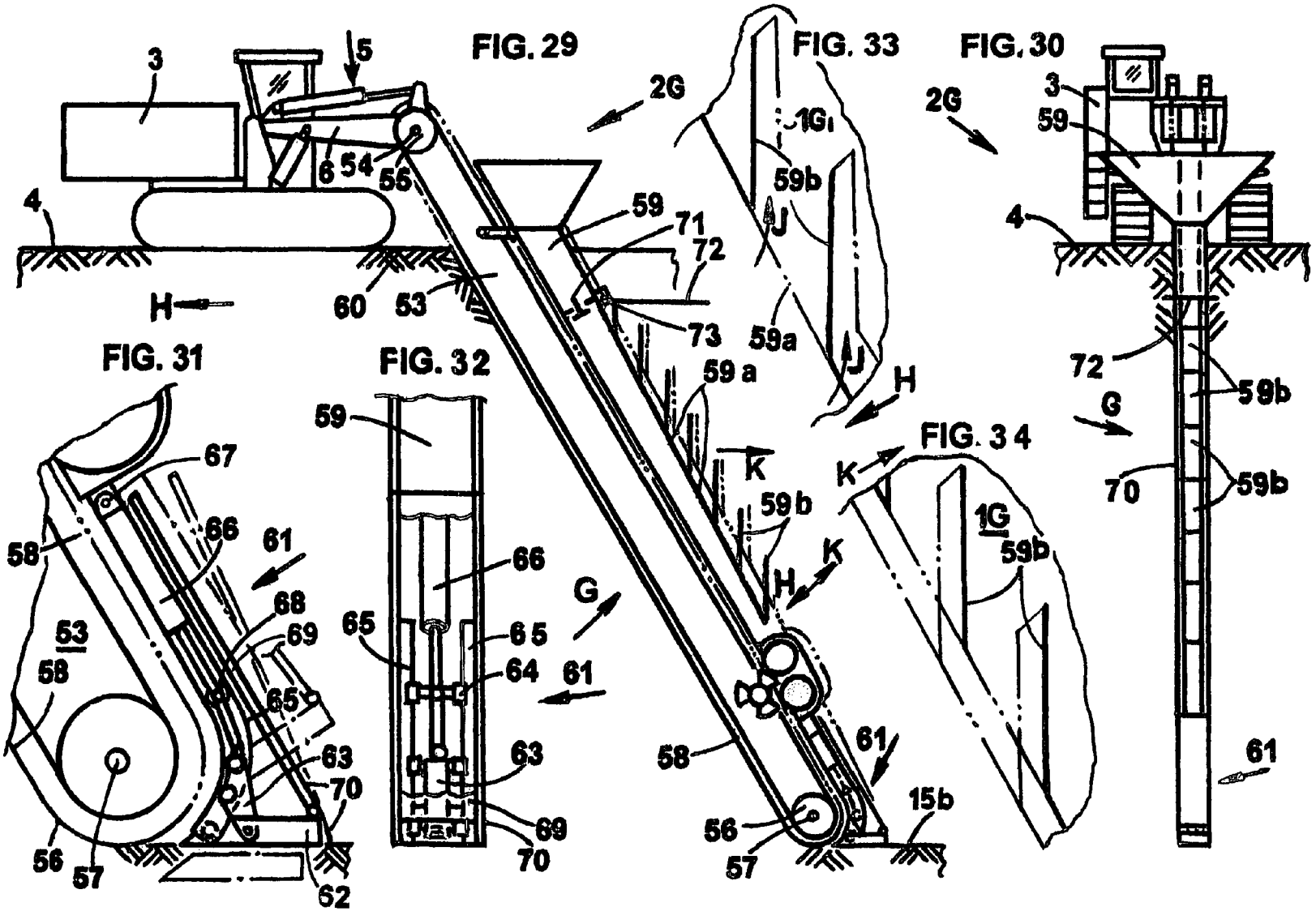
FIGS. 29 and 30 are side and from the rear views of a seventh preferred embodiment of the excavator according to the invention, respectively.
FIGS. 31 and 32 are partly side and from the rear on a slightly enlarged scale views of an oscillating tail ski and a compressor shield used on the endless chain cutter of the excavator shown in FIGS. 29 and 30, respectively.
FIGS. 33 and 34 are partly side views in retreated and compressing operative positions on a slightly enlarged scale of the compressor injection pipe shield of the excavator shown in FIGS. 29 to 32 according to the invention, respectively.

An illustrated embodiment 2G of the excavator 2 as shown in FIGS. 29 to 34 that is partly similar in construction to the excavators 2E and 2F and comprises the chassis 3, the framework 5 including the upper frame 6 and the lower frame shaped into an elongate guide post 53 supported at its upper portion on the frame 6 and disposed inclinedly backward, relative to an intended advancing direction shown by an arrow H in FIG. 29 at a predetermined angle, the angle being equal preferably to about 60° relative to the horizontal plane, a drive hydraulic preferably motor 54 provided on the guide post 53 and having the output shaft, a chain driving wheel 55 connected to a shaft of the motor 54, a chain sprocket 56 rotatably supported on a lower end of the guide post 53 by means of a pin 57, an endless chain 58 extending around the driving wheel 55 and the chain sprocket 56, a number of cutter bits (not shown) fixed to the chain 58; an elongate, filling-compressing, shield-shaped injection pipe and compressor 59 located at behind the cutter G and supported pivotally at its upper end on the guide post 53 about a generally horizontal shield pivotal axis of a pivot hinge means 60 which shield pivotal axis being perpendicular to a central longitudinal plane of the pipe shield 59, and at its lower end on the bottom 15*b* of the section 15 by a filling-compressing and bottom-ramming means 61 comprising a self-aligning, rammer and compressor tail ski 62 shown better in FIGS. 31 and 32, pivoted at its middle portion about a lower end of a carriage 63 movable with rolls 64 along the pipe shield 59 on guide rails 65 and adapted to be driven by a double acting, power hydraulic cylinder and piston unit 66 suitably coupled as at 67 via a bracket or the like to the lower portion of the pipe shield 59 and as at 68 by a linkage or a bracket or the like to the carriage 63 so as to move the tail ski 62 with the carriage 63 between a pipe shield 59-extending downward lower operative position represented by chain-dotted lines in FIG. 31 through a middle operative position represented by full lines in FIGS. 31 and 32 and a pipe shield 59-shortening upwardly, upper transporting position represented also by chain-dotted lines in FIG. 31. The tail ski 62 in the upper position can thus be nearly to the support means 60 that a lower end of the cutter G and permit the pipe shield 59 to be inserted from a starting, horizontal operative position represented in FIG. 9*a* into the section 15 follow the cutter G and to the middle operative position. The compressing and ramming means 61 comprises a face-compressing shield 69 and resilient scrapers 70 provided on edges of the shield 69 to engage on side walls and the bottom 15*b* of the section 15 for sealing the small gaps between the pipe shield 59 and the bottom 15*b* and side walls. The bottom-ramming ski 62 and the carriage 63 can thus be positioned more far from the supporting pivotal means 60 than the lower end of the cutter G and lengthen the pipe shield 59 toward the bottom 15*b* to secure supporting a front working face $1G_1$ of a ready filling wall G1 being formed in relation to the bottom 15*b* and ramming the bottom 15*b*. In the upper transporting position the pipe shield 59 is able to be supported at its lower portion on the guide post 53 by a middle supporting means like shown above by reference characters 45-49 in FIGS. 24, 26, 27. The unit 66 is capable of producing alternating oscillation of the pipe shield 59 in directions shown by arrows H and K in FIG. 29 about the axis of the hinge means 60. The injection shield pipe 59 extends from the hinge means 60 positioned above the ground level toward the compressing and ramming means 61, is provided with an entrance check valve 71 opening downwardly, a horizontally disposed, elongate, upper working wall face-supporting slider damper 72 connected at from behind the pipe shield 59 by means of a coupling 73 permitting relative limited movement between the pipe shield 59 and the slider 72 and having the ability to extend across an upper region of the section 15, and has a number of orifices 59*a* disposed below the check valve 71 up to the supporting means 61 and a number of extending vertically, oriented in the direction K, face-compressing facet portions 59*b* positioned between the orifices 59*a*. As the portions 59*b* swing in forward and backward directions shown by arrows H and K in FIGS. 29, 33 and 34 about the axis of the pivotal means 60, a compacted ready filling wall 1G will form as a running ready filler material such as a cement mortar is injected through the check valve 71 and the orifices 59*a* in a direction as shown by an arrow J in FIG. 33 into gaps formed between the portions 59*b* and the face $1G_1$ and is forced by the portions 59*b* in the direction K as shown in FIG. 34 and compressed on the face $1G_1$.

In constructing an underground continuous compacted ready filling wall 1G by using the excavator 2G constructed described above, the endless chain cutter G having a desired length that is assembled and placed in a horizontal position on the ground surface as shown in FIG. 9*a* where the wall 1G is to be formed. The unit 66 is then moves the ski 62 into the shortened position and thereafter the chain 58 of the cutter G is driven by means of the motor 54 in directions shown by arrows I and J in FIGS. 29 and 31, while the chassis 3 advances in the direction shown by an arrow H in FIG. 29 to form a continuous excavated trench section in the ground 4.

Figure 35A:
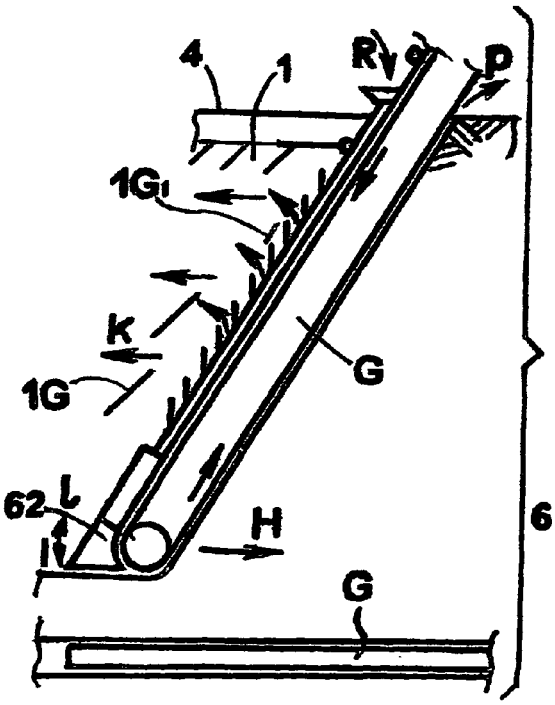
FIGS. 35*a* and 35*b* are views illustrating the processes of the third construction method according to the invention with using the excavator shown in FIGS. 29 to 34.

FIGS. 9*a* and 35*a* illustrate the third construction method according to the invention with using the excavator 2G. The endless chain cutter G of the excavator 2G according to the invention that including the compressor and injection pipe shield 59, the oscillating ski 62 and the compressor shield 69 is placed on the ground 4. Thereafter, the chassis 3 is driven in the predetermined direction shown by an arrow H in FIG. 9*a* to excavate the ground 4 and remove the earth as shown by an arrow P in FIG. 35*a* and the cutter G inserts into the ground 4 in a direction shown by an arrow N as shown in FIG. 9*a*, where the oscillating ski 62 is driven in the predetermined opposite directions I and J in FIG. 35*a*, while a running, hardening ready filler material such as a cement concrete mortar is poured in the excavated section through the pipe shield 59 as shown by an arrow O in FIG. 35*a*. As a result, the bottom of the excavated section is rammed, the ready filler material in the pipe shield 59 being oscillated is easily fill the section, the section is filled with the ready filler material to form a ready filling, a front working face 1$G_1$ of the ready filling is compressed to form a compacted ready filling wall 1G.

Figure 35B:
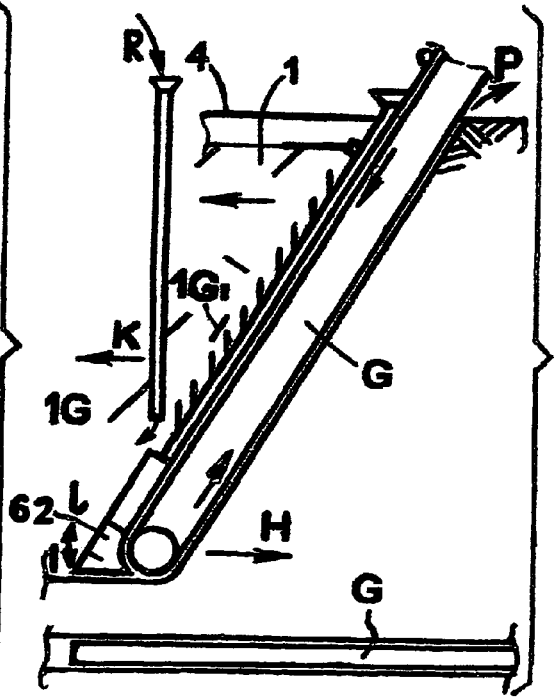

In other construction method, first, an agitator (not shown) is prepared, which is substantially similar in construction to the endless chain cutter G and includes the agitator pipe shield 59 provided on the guide post 53, the sealing packings 70 provided on the pipe shield 59 and the shield 69. The endless chain cutter G of the excavator 2G according to the invention is placed on the ground 4. The drive hydraulic unit 66 is then moves the ski 62 into the shortened position and thereafter the chassis 3 is driven in the predetermined direction shown by an arrow H in FIG. 9*a* to advance the agitator, while the agitator is inserted into the excavated section behind the cutter G, the oscillating ski 62 is driven in the predetermined opposite directions I and J in FIG. 35*b*, and a running hardening filler material is poured through the injection pipe 73 into the section as shown by an arrow R. As a result, the bottom of the section is compacted, the section is filled with the ready filler material to form a ready filling, and a front working face 1$G_1$ of the ready filling is agitated and compressed to form a compacted ready filling wall 1G.

These examples of the use of the excavator and the methods for constructing the underground, continuous, compacted filling walls show that there is possible to accomplish the both above-mentioned objects. An embodiment of the excavator, dimensions of an useful filling-compressing cutter, a required depth of the excavation may be varied depending on a purpose for which the wall and the excavator are to be adapted and on the properties of the ground. Such excavator according to the invention can act accordingly to the present invention and form in the preferably non-rocky grounds any predetermined compacted filling cut-off, impervious and retaining or water-draining screen walls of a thickness of about 0.2 to 0.5 meters (0.2-0.3 meters mainly) and of the depth up to 12-15 meters. The filling-compressing cutters of the excavator may be interchangeable depending on conditions of the ground. In one's capacity as a filler material may be used a waterproof sealing clay-cement mortar or water-permeable sand as pulp. As the chassis may be used conventional suitable chassises of well-known endless chain excavators and any conventional equipment for preparing draining and sealing filler and improving materials and for feeding that materials into the compressor cutter and a well-known drive means and exploring the better hydrogeological characteristics of the ground.

We claim as our invention:

1. An excavator for constructing an underground continuous, compacted filling wall, the excavator comprising:

a transporting chassis movable over the ground along the length of a line of the wall in a direction to produce the wall in a trench which extends in that direction;

a supporting framework mounted on the chassis and adapted to be transported in the direction to produce the wall;

an endless linear motive member and a number of cutter and compactor slider members arranged on the endless member to form a linear digger adapted to extend down into the ground from the framework;

a means supporting the motive member on the framework for longitudinal movement in intended and predetermined compacting directions crossing the advancing direction along a front working face of the wall;

a drive means for producing the longitudinal movement in the intended and predetermined compacting directions so that wall-compacting facet portions of each of the compactor members compact the filling generally toward and on the face as the framework is transported in the advancing direction.

2. The excavator according to claim 1, wherein the linear motive member is shaped into an endless linear motive member to form an endless linear digger that further comprising an endless member-driving wheel on the framework, a tiltable guide frame supported by the framework, and a plurality of endless member-guiding sprockets supported by the frame, and where the drive means is capable of effecting relative movement between the framework and the driving wheel.

3. The excavator according to claim 2, wherein each of the compactor slider members is supported on the endless member for alternating oscillation about a generally horizontal axis, the axis being within the pivotable compactor member and the endless member and perpendicular to a central longitudinal surface of the endless member and has oriented in the compacting directions, cutter edge portions and the opposite inner and outer, in relation to the endless member, compacting facet portions;

where the drive means is capable of effecting relative movements between the endless member and the compactor slider members.

4. The excavator according to claim 2, wherein the digger comprises a transverse dividing partition that separates front and rear runs of the digger and extending from the guide frame inside and up to the lower portion of the endless member and having a sealing means extending along lower and side edges of the partition and adapted to engage movingly with the intended edge portions of the slider members.

5. The excavator according to claim 4, wherein the slider members of the runs are adapted to engage movingly with the partition.

6. The excavator according to claim 1 and comprising a filling face-compacting shield adapted to extend along the depth and across the excavated section and provided with sealing means at its lower and side edge portions for engaging on a bottom and side walls of the section; and the supporting means is capable of supporting the underground portion of the shield in the section for alternating oscillation in the compressing directions, while the linear digger is being advanced continuously.

7. The excavator according to claim 6, wherein the underground portion of the shield is being supported on an underground portion of the guide frame located ahead of a rear run portion of the number of the cutter members.

8. The excavator according to claim 6, wherein the shield-supporting means comprises the underground portion of the guide frame extending backward, in relation to the advancing direction, closely aside, with a suitable clearance, of the rear run portion of the number of the cutter members.

9. The excavator according to claim 6, wherein the shield-supporting means comprises a number of shield-supporting cam wheels that being supported on the underground portion of the guide frame for rotation about a generally horizontal axis, the cam axis being perpendicular to the central longitudinal plane of the frame, connected cinematically to the endless member and comprising a plurality of shield-supporting and agitating radial cam portions having intended predetermined radial lengths and the ability of extending closely aside, with a suitable clearance, and past by the endless member and between the adjacent cutter bits;

where the underground portion of the shield is provided with paired, forward oriented, in relation to the advancing direction, shield-supporting wheels located oppositely to and with the ability of engaging with the cam portions and supported on the underground portion of the shield for rotation about generally horizontal wheel axes, the rotation shield wheel axes being perpendicular to the central longitudinal plane of the digger and shield;

where the cam portions are operable to support continuously and oscillate vibratory the shield alternately backward, relative to the advancing direction, and forward by the drive means capable of rotating the cam wheels about the rotation cam axes and the shield wheels about the rotation shield wheel axes to effect the continuous supporting, agitating and compacting the face.

10. The excavator according to claim 6, wherein the shield has a <-shaping upper and lower wing portions and a forward, in relation to the advancing direction, oriented ridge portion located between the wing portions;

where the upper wing portion comprising an upper injection channel including an upper pipe portion extending from the framework into the upper wing portion and having a lower end located above the ridge portion and provided with an upper exit check valve capable of opening downward; and an extending from the pipe portion, chute portion having a side opening oriented backward; and a lower pipe portion extending from the chute portion and having a lower end located at the ridge portion and provided with a lower check valve capable of opening downward, and having an upper, wall-compacting wing facet portion; and where the lower wing portion is shaped into an injection chute having a backward oriented side opening and a lower, wall-compacting wing facet portion to form a displacement pump; and where the underground shield-supporting means supports the shield for alternating forward and backward oscillation about a generally horizontal pivot axis, the pivot axis being within the shield-supporting means and the ridge portion and perpendicular to the central longitudinal planes of the shield-supporting means and the shield; and where a drive means of the excavator is capable of producing the alternating forward and backward oscillation of the shield about the generally horizontal pivot axis, so that the opposite facet portions of the shield wings disposed above and below the generally horizontal pivot axis alternately retreat from corresponding upper and lower portions of the compacted face of the filling wall being formed, generate upper and lower sectorial gaps between the facet portions and the face, suck a running filler material from the injection pipe portions through the opened check valves into the gaps and fill the gaps with the filler material, and then compact the filling in the gaps to close the check valves and to slide along the facet portions from the pivot axis toward and on the face being formed as the framework is transported in the advancing direction.

11. The excavator according to claim 1, wherein each of the slider compactor members has a filling face-compacting slide able facet portion capable to be positioned at a back angle, the back angle being equal to about 20-30° in relation to the compressing direction, the angle is depended on the cohesion and lesser than the angle of sliding friction of the portion on the filling, and operable by the drive means capable of producing movements of the blade in the compressing direction and about the pivot axis so that the inner facet portion of the blade alternately compresses the friable filling toward the face and retreats from the filling and the outer facet portion compresses the filling on the face and retreats from the face.

12. The excavator according to claim 1, wherein each of the compacting slider members is capable of pivoting between a front, cutting and filling-compressing position ahead of the guide frame, in relation to the advancing direction, and a rear, filling face-compressing position behind the guide frame; where the front position being secured by a traction force of the driving wheel, and resistance of a guide member supported motionless on the guide frame closely above the ground surface, and resistance of the ground being excavated from a front working wall of the excavated section being formed, and by the backward oriented edge portion of the blade and a limit stop of the endless member, and the rear position being secured by the forward oriented edge portion of the blade and a limit stop of the motive member.

13. The excavator according to claim 11, wherein the facet portions of each of the blades are operable by a return spring disposed between the endless member and the blade and capable of forcing the blade to pivot about the pivot axis from the front position into the rear position and against resistance of the face being compressed;

where the drive means with the driving wheel is capable of effecting the relative movement between the endless member and the blades against the resistance of the springs being deformed.

14. The excavator according to claim 1, wherein the endless motive member is shaped into an endless chain extending around a chain driving wheel and a chain sprocket to form an endless chain digger.

15. The excavator according to claim 1, wherein the endless motive member is shaped into a rotor extending around a rotor driving wheel and below rotor sprockets to form a rotor digger.

16. The excavator according to claim 8, wherein each of a number of the cutter bits is capable of urging an underground portion of the digger in a transversal direction toward the advancing direction.

17. An underground continuous, compacted filling wall construction method utilizing an excavator comprising: a traveling chassis advance able along a wall line path, a framework on the chassis, and an endless linear digger supported by the framework and having a tiltable guide member on the framework, a driving wheel and a number of guide sprockets rotatably connected to the guide member, an endless linear motive means supported by the driving wheel and the sprockets for relative movement, a number of cutter bits and a number of compactor blades alternately supported by the endless means for oscillation about axes which being within the endless means and the blades to form an endless linear digger having front and rear linear runs of the blades; the method comprising the following steps of:

digging a section of a slot excavation along the excavation line path in the ground to a predetermined depth and in an intended advancing direction by means of an excavating device;

feeding an intended filler material into the excavated section to form a filling within the section;

inserting a compactor substantially similar in construction to the endless linear digger, into the filling, thereby compacting the filling simultaneously from ahead of and behind of the endless member in a generally horizontal direction on a front working face of the filling to form a compacted filling wall;

propelling continuously the guide member with the endless means and the blades.

18. An underground continuous, compacted filling wall construction method utilizing an excavator comprising: a traveling chassis advance able along a wall line path, a framework on the chassis, and an endless linear digger supported by the framework and having a tiltable guide member on the framework, a driving wheel and a number of guide sprockets rotatably connected to the guide member, an endless linear motive means supported by the driving wheel and the sprockets for relative movement, a number of cutter bits and a number of compactor blades alternately supported by the endless means for oscillation about axes which being within the endless means and the blades to form an endless linear digger; and comprising the following steps of:

excavating the ground in the directions by means of the endless linear digger to form a section of the excavation and a ground earth filling in the section; while inserting a compactor substantially similar in construction to the endless linear digger, thereby compacting the earth filling simultaneously by front and rear linear runs of the members in a generally horizontal direction on a front working face of the filling to form a compacted earth wall.

19. An underground continuous, compacted filling wall construction method utilizing an excavator comprising: a traveling chassis advance able along a wall line path, a framework on the chassis, and an endless linear digger supported by the framework and having a tiltable guide member on the framework, a driving wheel and a number of guide sprockets rotatably connected to the guide member, an endless linear motive means supported by the driving wheel and the sprockets for relative movement, a number of cutter bits, a number of compactor blades alternately supported by the endless means for oscillation about axes which being within the endless means and the blades, and a partition located between and along front and rear runs of the blades to form an endless linear digger, and comprising the steps of:

excavating the ground in the directions by means of the endless linear digger to form a section of the excavation and a ground earth filling in the section; while inserting a compactor substantially similar in construction to the endless linear digger, thereby compacting the earth filling which being at ahead of the partition toward and under the lower end of the partition and on a lower portion of the face to form a compacted earth wall from its lower portion.

20. An underground continuous, compacted filling wall construction method utilizing an excavator comprising: a traveling chassis advance able along a wall line path, a framework on the chassis, and an endless linear digger supported by the framework and having a tiltable guide member on the framework, a driving wheel and a number of guide sprockets rotatably connected to the guide member, an endless linear motive means supported by the driving wheel and the sprockets for relative movement, a number of cutter bits, a number of compactor blades alternately supported by the endless means for oscillation about axes which being within the endless means and the blades, and a partition located between and along front and rear runs of the blades to form an endless linear digger, and comprising the steps of:

excavating the ground in the directions by means of the endless linear digger to form a section of the excavation and a ground earth filling in the section; while inserting a compactor substantially similar in construction to the endless linear digger, thereby compacting the earth filling toward and on the face to form a compacted earth wall;

inserting the partition into the earth filling being formed in the section;

feeding an improving filler material into the filling ahead of the partition;

compacting pair of an improving filling and the earth filling being mixed in the section at ahead of the partition toward and under the lower end of the partition and on the lower portion of the face to form the improved and compacted earth wall from its lower portion.

* * * * *